US005501444A

United States Patent [19]

Yukimachi et al.

[11] Patent Number: 5,501,444

[45] Date of Patent: Mar. 26, 1996

[54] SHEET SUPPLY APPARATUS

[75] Inventors: Hiroshi Yukimachi; Teruo Komatsu, both of Yokohama; Takahiro Azeta; Tsuyoshi Waragai, both of Kawasaki; Tomoyuki Araki, Tokyo; Osamu Hoshii, Kawasaki, all of Japan

[73] Assignee: Canon Kabushiki Kaisha, Tokyo, Japan

[21] Appl. No.: 287,416

[22] Filed: Aug. 9, 1994

[30] Foreign Application Priority Data

| | | | |
|---|---|---|---|
| Jan. 18, 1993 | [JP] | Japan | 6-003622 |
| Aug. 19, 1993 | [JP] | Japan | 5-205225 |
| Aug. 31, 1993 | [JP] | Japan | 5-216047 |
| Nov. 19, 1993 | [JP] | Japan | 5-290743 |
| Nov. 19, 1993 | [JP] | Japan | 5-290747 |
| Nov. 19, 1993 | [JP] | Japan | 5-290748 |

[51] Int. Cl.[6] ..... B65H 1/08

[52] U.S. Cl. ..... 271/127; 271/117; 271/153; 271/156; 271/10.11; 271/9.11; 271/9.13

[58] Field of Search ..... 271/126, 127, 271/110, 117, 147, 152, 153, 156, 157, 10.11, 9.11, 9.13

[56] References Cited

U.S. PATENT DOCUMENTS

| | | | |
|---|---|---|---|
| 3,667,385 | 6/1972 | Suzaki | 271/126 X |
| 4,953,846 | 9/1990 | Azeta et al. | 271/251 |
| 5,155,537 | 10/1992 | Komatsu et al. | 355/309 |

OTHER PUBLICATIONS

Binkhuysen, Hopper Mechanism, IBM Technical Disclosure Bulletin, vol. 17, No. 1, pp. 147–148, Jun. 1974.

*Primary Examiner*—William E. Terrell
*Assistant Examiner*—Carol L. Druzbick
*Attorney, Agent, or Firm*—Fitzpatrick, Cella, Harper & Scinto

[57] ABSTRACT

The present invention provides a sheet supply apparatus comprising a lifter device for maintaining a height of an upper surface of a sheet stack supported by a sheet supporting device substantially constant by lifting or lowering the sheet supporting device, and a supply device for feeding out an uppermost sheet from the sheet stack maintained in a constant height position by the lifter device, and wherein the lifter device comprises a clutch member for transmitting a predetermined amount of rotation from a drive gear, a rock member for rocking a ratchet pawl by the rotation transmitted by the clutch member, a ratchet gear engageable by the ratchet pawl and rotated by a rocking movement of the ratchet pawl, a lifter member connected to the ratchet gear and adapted to lift the sheet supporting member by rotation of the ratchet gear, and an actuation device shifted in accordance with the height of the upper surface of the sheet stack rested on the sheet supporting device and adapted to actuate the clutch member when the height of the upper surface of the sheet stack is below a predetermined height.

22 Claims, 29 Drawing Sheets

SHEET SUPPLY APPARATUS

BACKGROUND OF THE INVENTION

1. Field of the Invention

The present invention relates to a sheet supply apparatus incorporated into an image forming apparatus such as a printer, a copying machine, a facsimile and the like, and more particularly, it relates to a sheet supply apparatus having a lifter means for maintaining a height of an uppermost sheet substantially constant.

2. Related Background Art

Among sheet supply apparatuses incorporated into an image forming apparatus, there is a sheet supply apparatus having a lifter means for maintaining a height of an uppermost sheet in a sheet stack substantially constant so that a sheet is fed out by a sheet supply means such as a sheet supply roller at a constant height position. In such a lifter means, in order to maintain the height of the uppermost sheet constant, for example, a lever is abutted against an upper surface of the sheet stack, displacement of the lever is detected by an electrical sensor such as a photo-sensor, and an electrical actuator such as a motor or a strong solenoid for lifting and lowering a sheet stacking plate on which sheets are stacked as the sheet stack is energized on the basis of a detection result of the electrical sensor.

Further, in some conventional sheet supply apparatuses, a sheet supply roller can be shifted to be abutted against or separated from the uppermost sheet of the sheet stack the height of which is kept constant by the lifter means. In this arrangement, after the sheet is fed out by the sheet supply roller abutted against the sheet, by separating the sheet supply roller from the sheet, load (back tension) acting on the sheet is reduced.

In the past, an exclusive electrical actuator such as a motor or a solenoid similar to that associated with the lifter means has been used as a mechanism for lifting and lowering the sheet supply roller with respect to the sheet. However, in the conventional sheet supply apparatus having the lifter means and the mechanism for shifting the sheet supply roller, the following problems arose:

(1) Since the electrical sensor, the actuator for the lifter means and the exclusive actuator for lifting and lowering the sheet supply roller must be provided, the entire sheet supply apparatus becomes expensive, and large electrical capacity is required;

(2) Since complex wiring is required for electrically connecting the electrical sensor and the exclusive actuators to associated elements, miss-wiring is apt to occur; and (3) Electrical control sequence for the sheet supply system becomes complex, and, thus malfunction is apt to occur.

SUMMARY OF THE INVENTION

An object of the present invention is to provide a sheet supply apparatus which is inexpensive and which has good assembling feature and can reduce occurrence of malfunction.

To achieve the above object, the present invention provides a sheet supply apparatus having a lifter means for maintaining a height of an upper surface of a sheet stack supported by a sheet supporting means substantially constant by lifting or lowering the sheet supporting means, and a sheet supply means for feeding out an uppermost sheet from the sheet stack maintained in a constant height position by the lifter means. Wherein the lifter means comprises a clutch means for transmitting a predetermined amount of rotation from a drive gear, a rock means for rocking a ratchet pawl by the rotation transmitted by the clutch means, a ratchet gear engageable by the ratchet pawl and rotated by a rocking movement of the ratchet pawl, a lifter member connected to the ratchet gear and adapted to lift the sheet supporting member by rotation of the ratchet gear, and an actuation means shifted in accordance with the height of the upper surface of the sheet stack and adapted to actuate the clutch means when the height of the upper surface of the sheet stack is below a predetermined height.

The present invention also provides a sheet supply apparatus comprising a sheet supporting means adapted to support a sheet and removably mounted to the apparatus, a supply means movable in an up-and-down direction and adapted to be abutted against an upper surface of the sheet rested on the sheet supporting means to feed out the sheet at a supply position, a shift means for lowering the supply means to abut the supply means against the upper surface of the sheet when the sheet is to be supplied and for lifting the supply means to a waiting position spaced apart from the upper surface of the sheet when the sheet is not supplied, a rock means for rocking a ratchet pawl by rotation of a drive gear, a ratchet gear engageable by the ratchet pawl and rotated by a rocking movement of the ratchet pawl, a lifter member connected to the ratchet gear and adapted to lift the sheet supporting member by rotation of the ratchet gear, an actuation means for driving the rock means in accordance with an abutment position between the supply means at the supply position and the sheet supported by the sheet supporting means, a lock means for regulating movement of the shift means under a condition that the supply means is lowered in response to a mounting operation of the sheet supporting means to the apparatus, and a lock releasing means for releasing the regulation of the lock means when the upper surface of the sheet supported by the sheet supporting means is brought to a predetermined position by the lifter means.

DETAILED DESCRIPTION OF THE PREFERRED EMBODIMENTS

Figure 1:
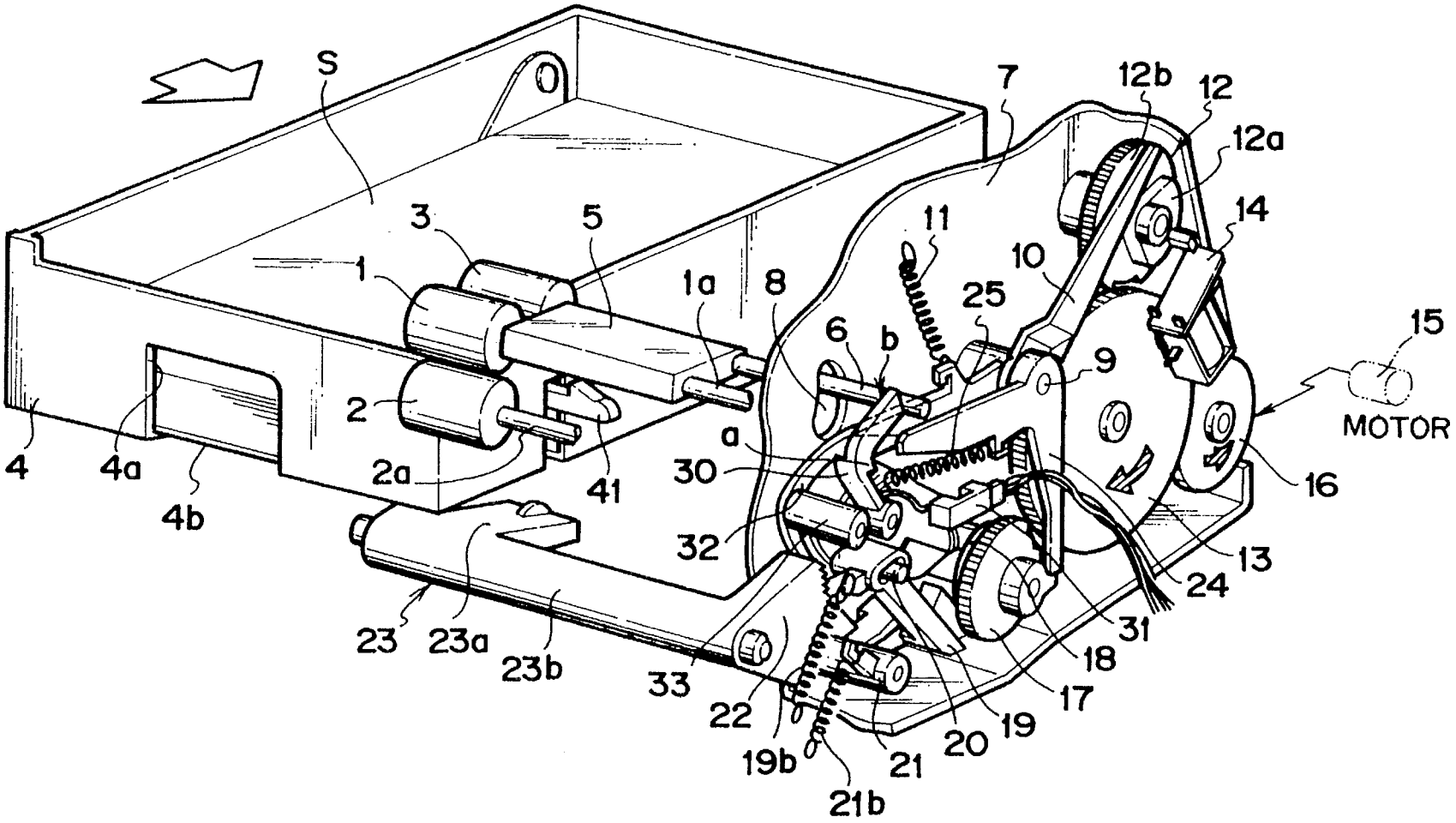
FIG. 1 is a perspective view of a sheet supply apparatus according to a preferred embodiment of the pre sent invention.

First of all, a sheet supply apparatus according to a preferred embodiment of the present invention will be explained with reference to FIGS. 1 to 14B. FIG. 1 shows a condition that a sheet cassette 4 is being inserted into the sheet supply apparatus from a direction shown by the arrow.

The sheet supply apparatus comprises a feed roller 1, a retard roller 2 and a pick-up roller 3. Sheets S stacked in the sheet cassette 4 are separated and supplied one by one by these three rollers. A stepping motor (not shown) is attached to a frame 7 so that a driving force from the stepping motor is transmitted to a roller shaft 1*a* of the feed roller 1 and a roller shaft 2*a* of the retard roller 2. The pick-up roller 3 is rotated by transmitting a driving force of the feed roller 1 to the pick-up roller 2 via a gear train (not shown ).

Figure 2:
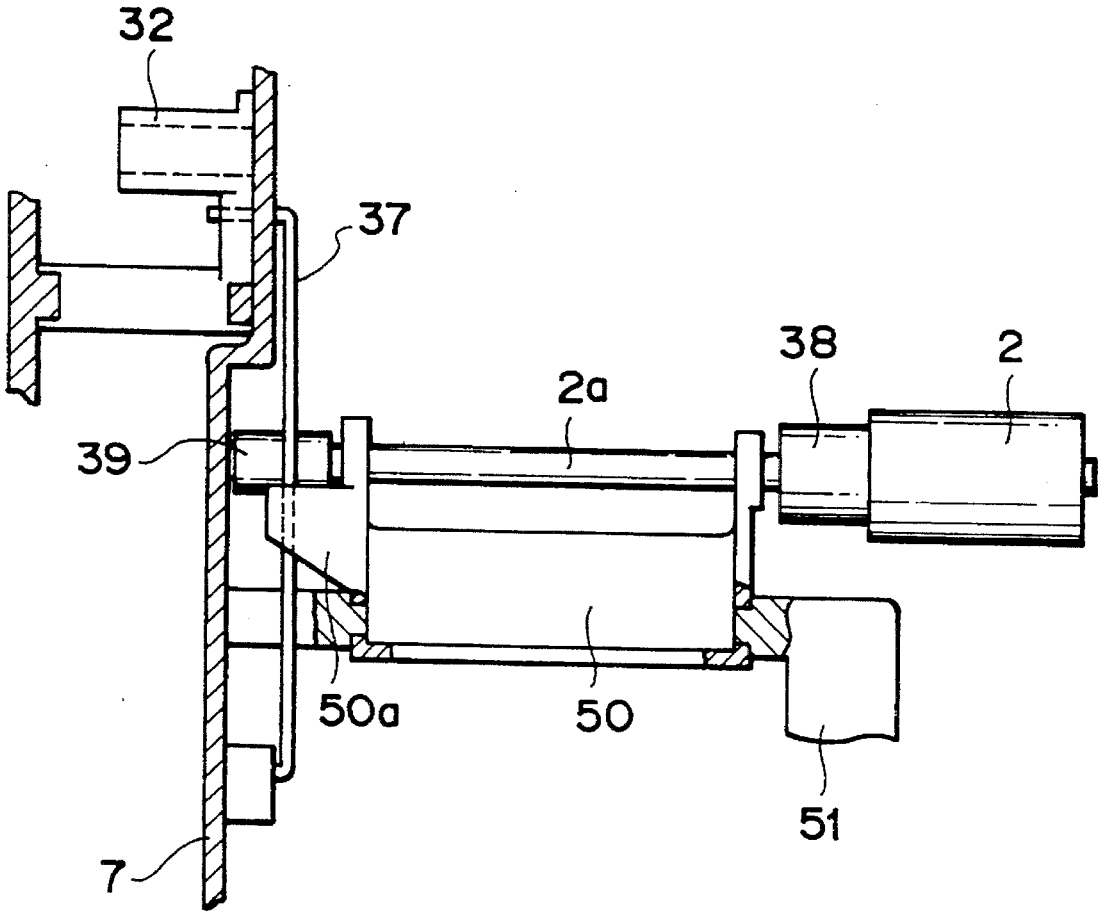
FIG. 2 is a view of a retard roller provided in the apparatus of FIG. 1 looked at from below.
Figure 3A:
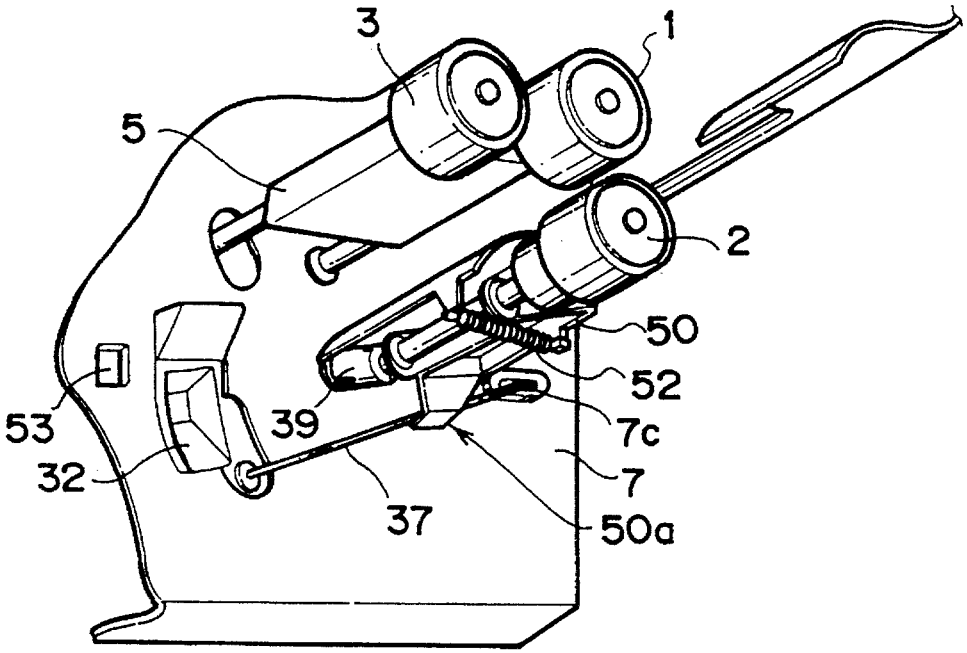
FIGS. 3A and 3B are perspective views showing a separation pressure releasing condition of the retard roller provided in the apparatus of FIG. 1.
Figure 3B:
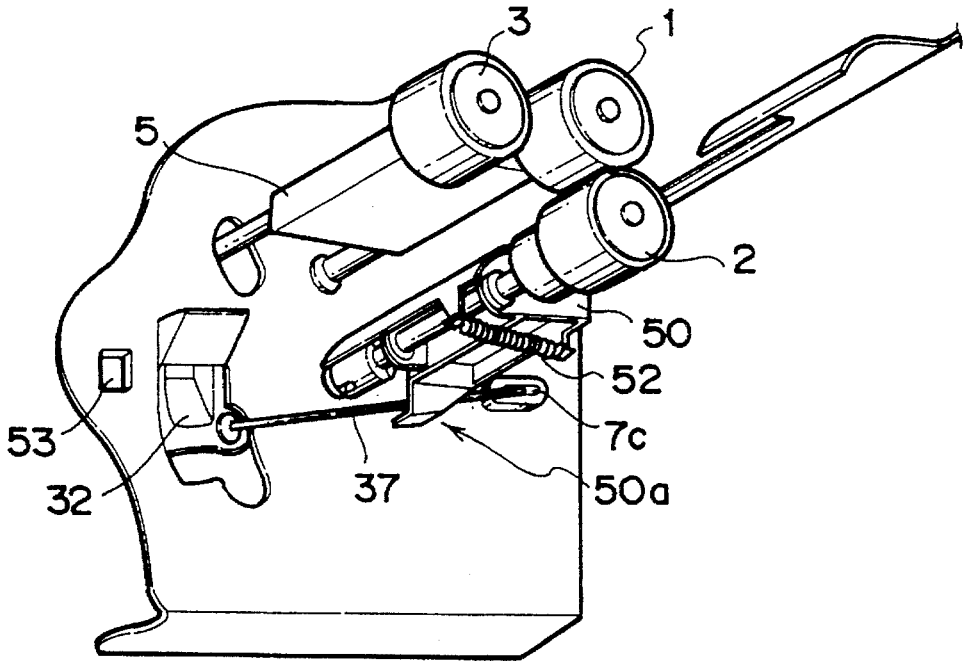

As shown in FIGS. 2, 3A and 3B, the retard roller 2 is supported by a support member 50 rockably mounted on a bearing member 51 so that the retard roller can be abutted against and separated from the feed roller 1 in a parallel condition. Further, the support member 50 is biased by a spring 52 connected between the support member and the bearing member 51 so that the retard roller 2 is urged against the feed roller 1 with predetermined separation pressure.

A torque limiter 38 is arranged on the roller shaft 2*a* of the retard roller 2 so that normal and reverse rotations of the retard roller 2 are controlled by the torque limiter 38. Incidentally, a universal joint 39 is also arranged on the roller shaft 2*a* so that the rotation can be transmitted even if the retard roller 2 is separated from the feed roller slightly due to the insertion of the sheet between the feed roller 1 and the retard roller 2.

Returning to FIG. 1, the feed roller 1 and the pick-up roller 3 are supported by a roller holder 5 which is pivotally mounted on the roller shaft la of the feed roller 1, so that the pick-up roller 3 can be rocked around the roller shaft la of the feed roller 1. A shaft 6 (referred to as "pick-up roller shaft" hereinafter) of the pick-up roller extends to the right in FIG. 1 through a slot 8 formed in the frame 7.

Figure 4A:
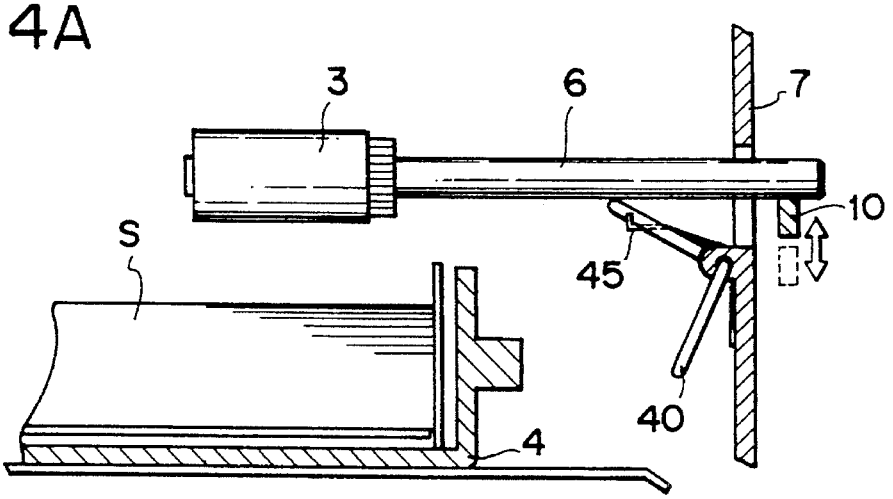
FIGS. 4A to 4C are views for explaining an operation of a mechanism provided in the apparatus of FIG. 1 and adapted to lift and lower a pick-up roller in synchronous with a mounting movement of a sheet cassette.
Figure 4B:
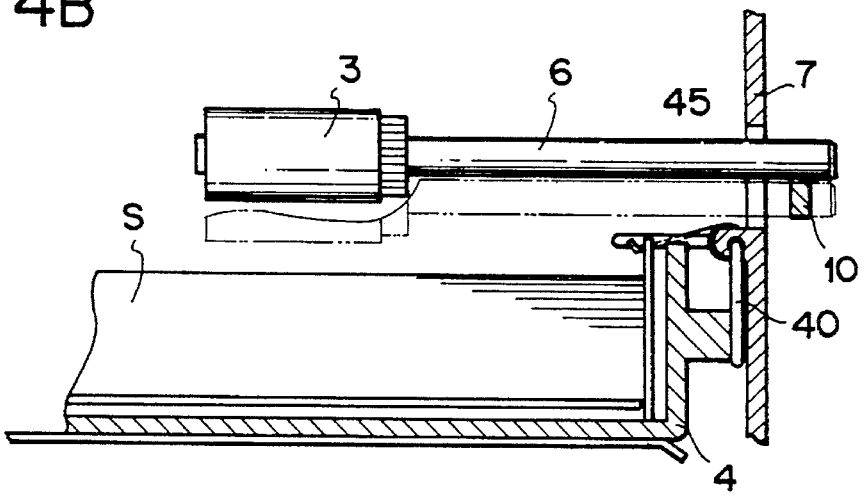
Figure 4C:
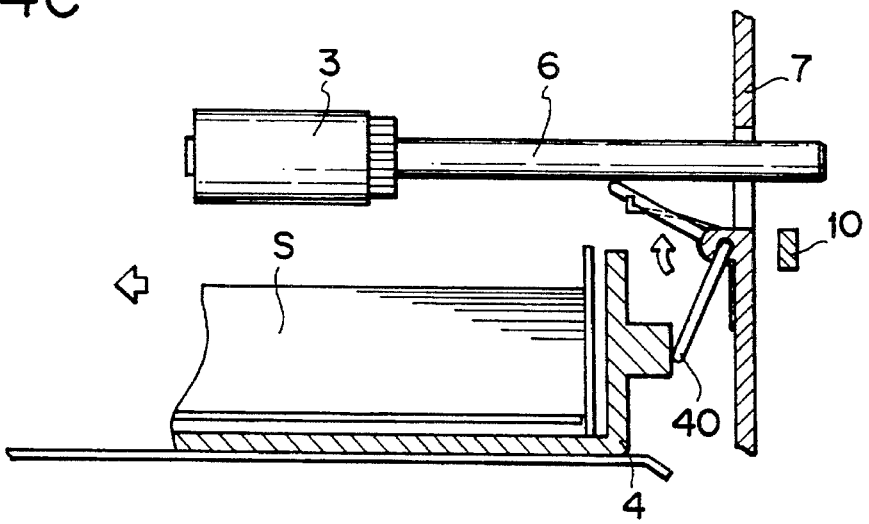
Figure 5:
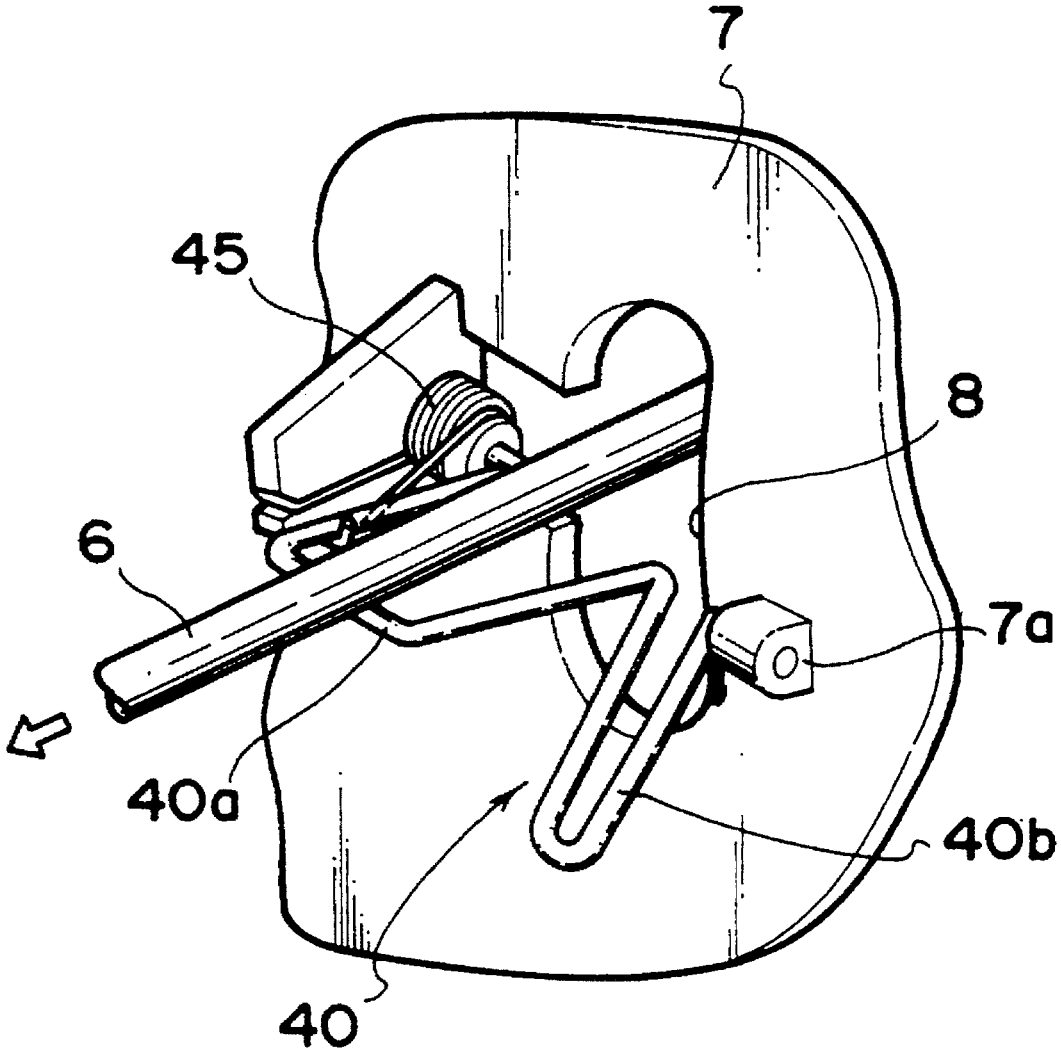
FIG. 5 is a perspective view of the mechanism of FIGS. 4A to 4C.

A mechanism for lifting and lowering the pick-up roller 3 in synchronous with a mounting movement of the sheet cassette 4 is arranged within the slot 8 of the frame 7. As shown in FIGS. 4A to 5, this mechanism comprises a lever member 40, and a spring 45 for biasing the lever member 40 in a clockwise direction. The lever member 40 is formed from a metal wire and is pivotally mounted in a bearing portion 7*a* integrally formed with the frame 7 and comprises an push-up portion 40*a* for pushing up the pick-up roller shaft 6 inserted in the slot 8, and an abutment portion 40*b* for rocking the lever member 40 in opposition to a biasing force of the spring 45 when the sheet cassette 4 is mounted to the apparatus.

In FIG. 1, a lift arm lever 10 is rotatably attached to a shaft 9 integrally formed with the frame 7 and is biased in a clockwise direction (FIG. 1) by a spring 11 connected to the lift arm lever. Further, the pick-up roller shaft 6 is abutted against one end of the lift arm lever 10. The other end of the lift arm lever 10 extends up to the proximity of a pick-up cam 12 so that, when the pick-up cam 12 is rotated, the lift arm lever 10 is rocked. Thus, when the pick-up cam 12 is rotated, the pick-up roller shaft 6 is shifted in an up-and-down direction via the lift arm lever 10, thereby lifting or lowering the pick-up roller 3.

The pick-up cam 12 comprises a cam portion 12*a* with which the lift arm lever 10 is slidingly contacted, and a gear portion 12*b* engageable by a drive gear 13. The gear portion is a so-called notched gear having a partial notched portion (having no tooth). The pick-up gear 12 is biased in an anti-clockwise direction in FIG. 1 by a biasing means (not shown) such as a spring, and rotation of the pick-up gear 12 is regulated by a solenoid 14 of flapper type in opposition to a biasing force of the biasing means. Further, a driving force from a main motor 15 of the apparatus is transmitted to the drive gear 13 via a gear 16 so that the drive gear 13 is always rotated.

Next, a lifter mechanism used in the illustrated embodiment will be explained.

A gear 17 is rotatably supported by the frame 7 and a lift-up cam 18 is disposed on a rotary shaft of the gear 17. The gear 17 is engageable by the drive gear 13 and has a notched portion (having no tooth). Further, the gear 17 is biased in an anti-clockwise direction by a biasing means (not shown).

A lift arm pawl 19 is pivotally mounted on a shaft 20 and is biased by a spring **19*b* so that a pawl portion 19*a* (FIGS. 11A to 14B) of the lift arm pawl is meshed with a toothed surface of a sector ratchet gear 22. The lift arm pawl 19 is rocked around the shaft 20 by rotation of the lift-up cam 18, thereby rotating the sector ratchet gear 22 in an anti-clockwise direction in FIG. 1 or FIGS. 11A and 11**B step by step.

A pawl portion **21*a* (FIGS. 8A, 8B and 11B) of a lift lock pawl 21 pivotally supported is urged against the toothed surface of the sector ratchet gear 22 by a spring 21*b*, thereby preventing the sector ratchet gear 22 from rotating reversely (in a clockwise direction in FIG. 1**).

With this arrangement, in a condition that the reverse rotation of the sector ratchet gear 22 is prevented by the lift lock pawl 21, when the sector ratchet gear 22 is rotated by the lift arm pawl 19, a lift-up member 23 integrally formed with the sector ratchet gear 22 is lifted through an opening **4*a* formed in the sheet cassette 4, thereby lifting up the sheets S in the sheet cassette 4. Incidentally, the sheet cassette 4 is provided with a rockable intermediate plate 4*b* on which the sheets S are stacked, so that, when a lift portion 23*a* of the lift-up member 23 is rocked upwardly, the sheets are lifted via the intermediate plate 4*b***.

Now, the lift-up member 23 will be fully described with reference to FIGS. 6A and 6B.

Figure 6A:
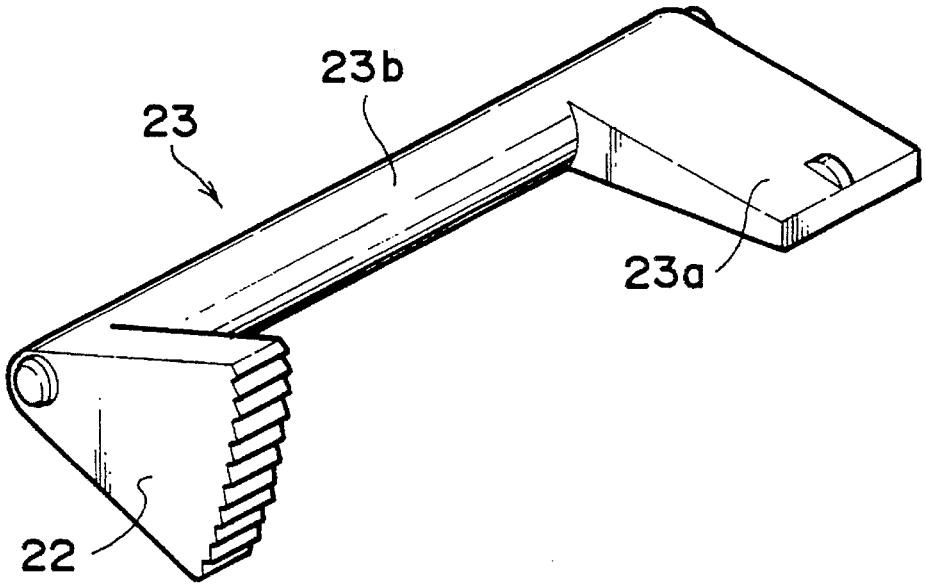
FIGS. 6A and 6B are perspective views showing examples of lift-up members provided in the apparatus of FIG. 1.

FIG. 6A shows a one-piece lift-up member 23 comprising a lift portion **23*a*, a sector ratchet gear 22 and a connecting shaft portion 23*b* connecting the lift portion and the sector ratchet gear, which portions 23*a*, 2 and 23*b* are integrally formed with each other. The lift-up member 23** is made of glass-reinforced synthetic resin, for example, to provide high rigidity.

Figure 6B:
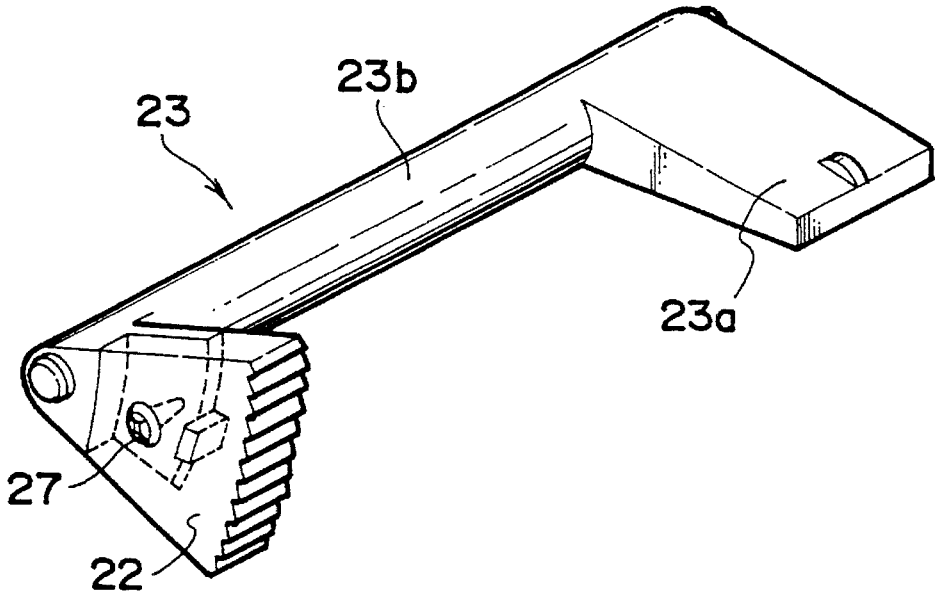

FIG. 6B shows a two-piece lift-up member 23 comprising a sector ratchet gear 22 made of resin such as polyacetal providing the required sliding ability, and a lift portion **23*a* and a connecting shaft portion 23*b* which are made of glass-reinforced synthetic resin to provide high rigidity. The sector ratchet gear 22 is positioned with respect to the connecting shaft portion 23*b* by boss/hole fitting connection and is firmly secured to the connecting shaft portion 23*b* by a screw 27. Incidentally, the sector ratchet gear 22 may be removably connected to the connecting shaft portion 23*b*** via press-fit, for example. In this case, if the sector ratchet gear is damaged, the sector ratchet gear alone can be replaced by new one.

Since the above-mentioned one-piece or two-piece lift member 23 can support a heavy weight, for example, such a lift member 23 can be used with a sheet cassette containing sheets of large size or a sheet cassette containing a large number of sheets. Further, in the one-piece lift member, the sector ratchet gear 22 is not displaced (i.e. not out-of-phase) with respect to the lift portion **23*a***, and, in the two-piece lift member, out-of-phase between the sector ratchet gear and the lift portion can be substantially prevented. Thus, it is possible to control a height of the sheet stack S with high accuracy.

In FIG. 1, a lifter trigger lever 24 is pivotally mounted on the shaft 9 integrally formed with the frame 7 and is biased in a clockwise direction in FIG. 1 by a spring 25. One end of the lifter trigger lever 24 acts as a regulating member for regulating the rotation of the notched gear 17 integral with the lift-up cam 18 in a condition that the notched portion of the notched gear 17 is opposed to the drive gear 13. The other end of the lifter trigger lever 24 is abutted against the pick-up roller shaft 6 when the pick-up roller 3 is lowered to a predetermined position.

When the pick-up roller shaft 6 is lowered to a predetermined position, the lifter trigger lever 24 is rocked to release the regulation of rotation of the lift-up cam 18 (regulated by one end of the lever 24), thereby slightly rotating the lift-up cam 18 by the biasing means (not shown). As a result, the notched gear 17 is engaged by the drive gear 13 to rotate the lift-up gear 18, thereby rocking the lift arm pawl 19 to rotate the sector ratchet gear 22, with the result that the lift-up member 23 is lifted. Further, when the lift-up member 23 is lifted to lift the pick-up roller 3 via the sheets S, the lifter trigger lever 24 is returned to rotate in the clockwise direction, thereby regulating the rotation of the lift-up cam 18 again.

A pick-up lock lever 30 is biased in a clockwise direction in FIG. 1 by the spring 25 and comprises a pawl portion a and a hood portion b overhanging above the pick-up roller shaft 6. The pawl portion a serves to catch and lock the lift-up lever 10 when the lever 10 is lowered to a lowermost position, and the hood portion b serves to rotate the pick-up lock lever 30 in an anti-clockwise direction in FIG. 1 in opposition to a biasing force of the spring 25 when the pick-up roller shaft 6 is lifted, thereby releasing the end of the lift-up lever 10 from the pawl portion a to permit the lifting movement of the lift-up lever 10.

A photo-sensor 31 serves to detect the mounting of the sheet cassette 4, and a connecting lever 32 is pivotally mounted on a shaft 33.

Figure 7A:
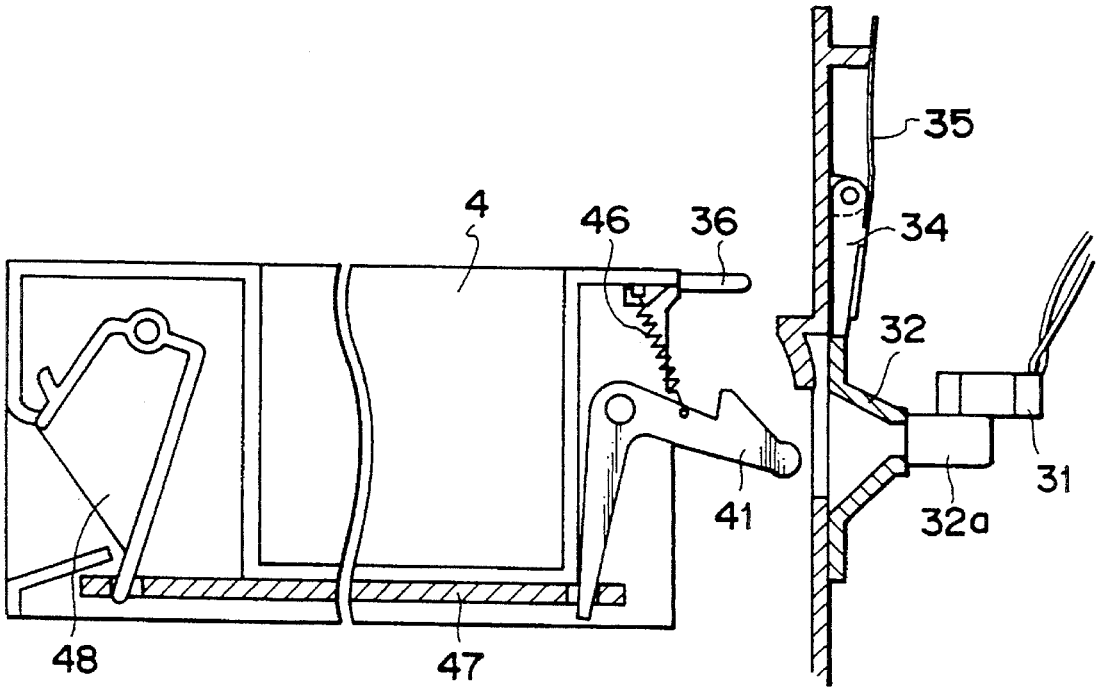
FIGS. 7A and 7B are sectional views showing a mounting operation of the sheet cassette associated with the apparatus of FIG. 1.
Figure 7B:
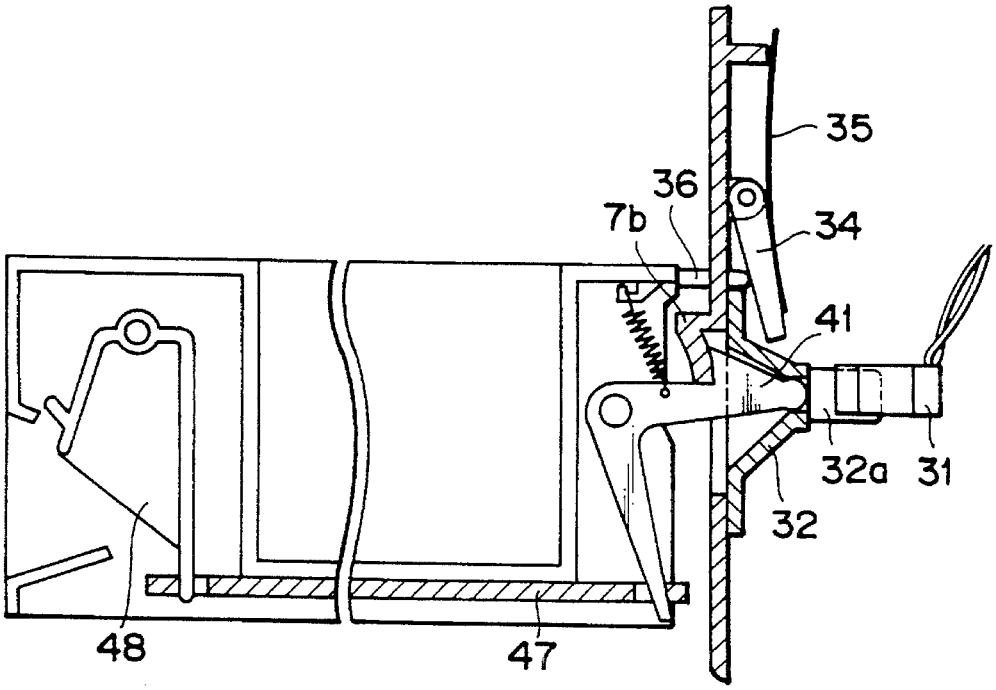

As shown in FIGS. 7A and 7B, a ratch pawl 41 is rotatably attached to the sheet cassette 4, when ratch pawl is connected to a grip 48 formed on a front side of the sheet cassette 4 via a rod 47. The ratch pawl 41 is normally biased in an anti-clockwise direction by a spring 46. However, when the grip 48 is pulled, the ratch pawl 41 can be rotated in a clockwise direction.

When the ratch pawl 41 is fitted into the connecting lever 32, the latter is rocked. As shown in FIG. 7A, when the sheet cassette 4 is not mounted, the connecting lever 32 is in a lowered position where the connecting lever 32 is fixed or stopped by a lock member 34. When the sheet cassette 4 is mounted, as shown in FIG. 7B, a projection 36 formed on the sheet cassette 4 enters into a hole 53 formed in the frame 7 to rock the lock member 34 in opposition to an elastic force of a leaf spring 35, thereby releasing a locking condition. As a result, the ratch pawl 41 is fitted into the connecting lever 32 to rock the latter upwardly. When the ratch pawl 41 is fitted into the connecting lever 32, a pawl portion 41a of the ratch pawl 41 is engaged by an engagement portion **7*a* formed on the frame 7, thereby fixing the sheet cassette 4**.

Incidentally, a flat **32*a* for blocking the photo-sensor 31 is formed on the connecting lever 32 so that, when the sheet cassette 4 is mounted in place, the photo-sensor 31 is blocked by the flag 32*a*, thereby detecting the mounting of the sheet cassette 4**.

Although not shown, a portion of the connecting lever 32 protrudes up to the proximity of the lift-up cam 18 to regulate the rotation of the lift-up cam 18 when the connecting lever 32 is in the lowered position (i.e. when the sheet cassette 4 is not mounted). In this condition, the lift-up cam 18 cannot be rotated regardless of the position of the lifter trigger lever 24. When the sheet cassette 4 is mounted and the connecting lever 32 is lifted, the regulation of rotation of the lift-up cam 18 is governed by the lifter trigger lever 24.

Further, as shown in FIGS. 2, 3A, 3B, 8A and 8B, one end of a release rod 37 is rotatably supported by the connecting lever 32 to separate the retard roller 2 from the feed roller 1. The other end of the release lever 37 is fitted into a groove 7*c* formed in the frame 7. An intermediate portion of the release lever 37 can be engaged by a protruded portion 50*a* formed on the support member 50 for supporting the retard roller 2. In a condition that the connecting lever 32 is lifted, the release lever 37 is not engaged by the protruded portion 50*a*. However, when the connecting lever 32 is lowered, the release lever 37 is engaged by the protruded portion 50*a*, thereby pushing the support member 50 downwardly. As a result, the retard roller 2 is separated from the feed roller 1, thereby releasing the separation pressure.

Figure 9A:
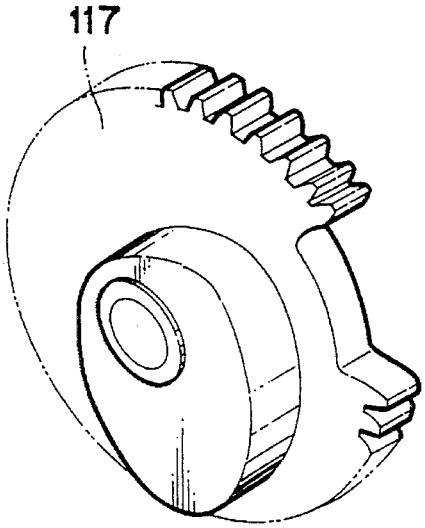
FIGS. 9A and 9B are views showing an example of a conventional notched gear.
Figure 9B:
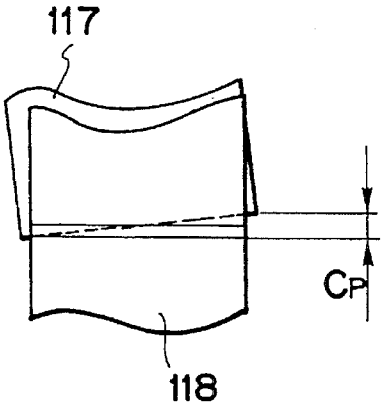

Next, the notched gears 12*b*, 17 associated with the pick-up cam 12 and the lift-up cam 18 will be explained with reference to FIGS. 6A to 7B. Incidentally, FIGS. 9A and 9B show an example of a conventional notched gear.

Figure 10A:
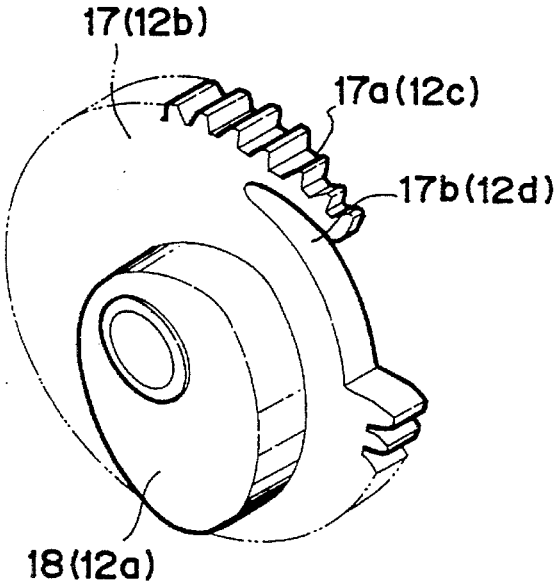
FIGS. 10A and 10B are views showing an example of a notched gear used with the sheet supply apparatus according to the present invention.
Figure 10B:
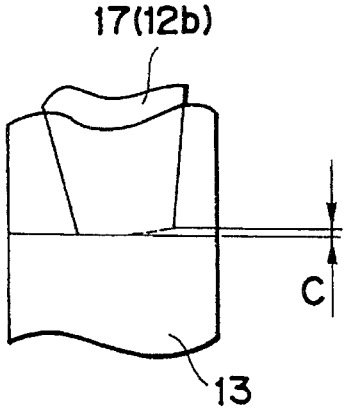

In the illustrated embodiment, as shown in FIGS. 10A and 10B, the notched gears 12*b*, 17 have mesh start portions 12*c*, 17*a* which are firstly engaged by the drive gear 13. Each of the mesh start portions 12*c*, 17*a* has a width gradually decreasing toward a tip end of the mesh start portion.

Further, recesses 12*d*, 17*b* are formed under the mesh start portions 12*c*, 17*a* of the notched gears 12*b*, 17, thereby damping any shock generated when the gears are meshed with each other.

With this arrangement, as shown in FIG. 10B (which is a view looked at from a radial direction of FIG. 10A), even if the parallelism between the gear shafts of the gears to be meshed with each other is slightly wrong, it is possible to prevent the collision between tip ends of teeth of the gears. As apparent from the comparison between the notched gear shown in FIGS. 10A and 10B and the conventional notched gear shown in FIGS. 9A and 9B, this can be understood from the fact that an intersect amount C between the notched gear 17 (12*b*) and the drive gear 13 when these gears are just meshed with each other is considerably smaller than a conventional intersect amount Cp (FIG. 9B).

Incidentally, in the illustrated embodiment, while the width of the mesh start portion of each notched gear was smaller than that of the other portion to prevent the reduction of rigidity of the other portion, for example, even when the notched gear is made of material having high rigidity, the width of the entire notched gear may be smaller than that of the associated gear (drive gear) to be meshed with the notched gear.

Next, the operation of the sheet supply apparatus will be explained.

Figure 14A:
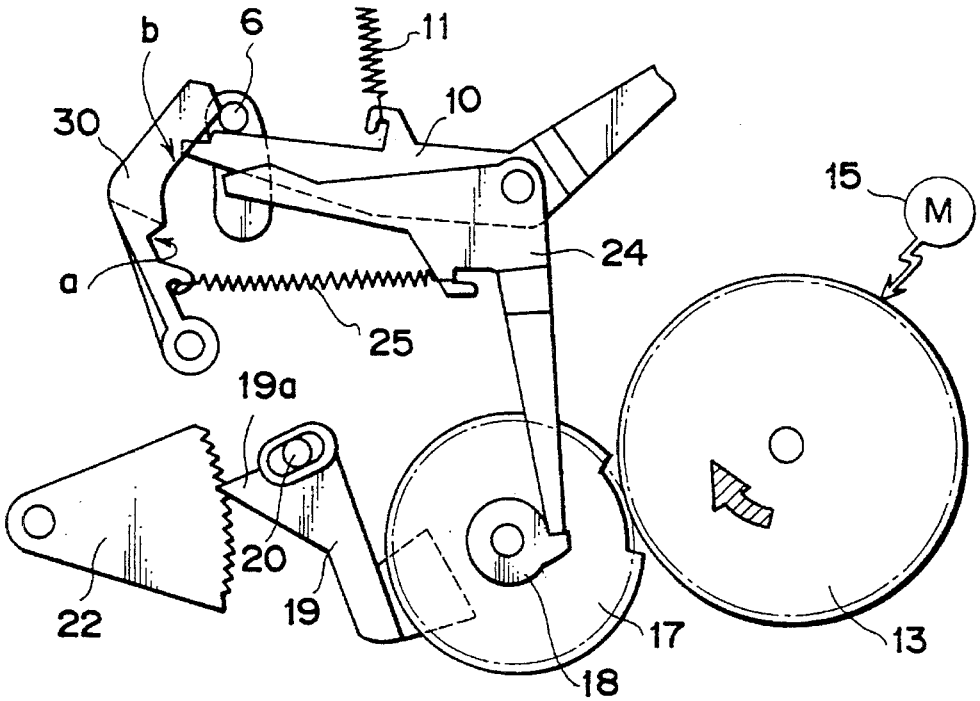
FIGS. 14A and 14B are enlarged views showing an operation for transferring the sheet cassette mounted condition (to the apparatus of FIG. 1) to the starting condition for bringing the apparatus to the stand-by condition.

First of all, before the sheet cassette 4 containing the sheets S is mounted to the sheet supply apparatus, as shown in FIGS. 1 and 14A, while the drive gear 13 is being continuously rotated by the driving force of the main motor 15 of the apparatus, since both of the notched portions of the notched gears (12*b*, 17) associated with the pick-up cam 12 and the lift-up cam 18 are opposed to the drive gear 13, the driving force of the drive gear is not transmitted to the cams 12, 18, with the result that these cams are not rotated.

Figure 11A:
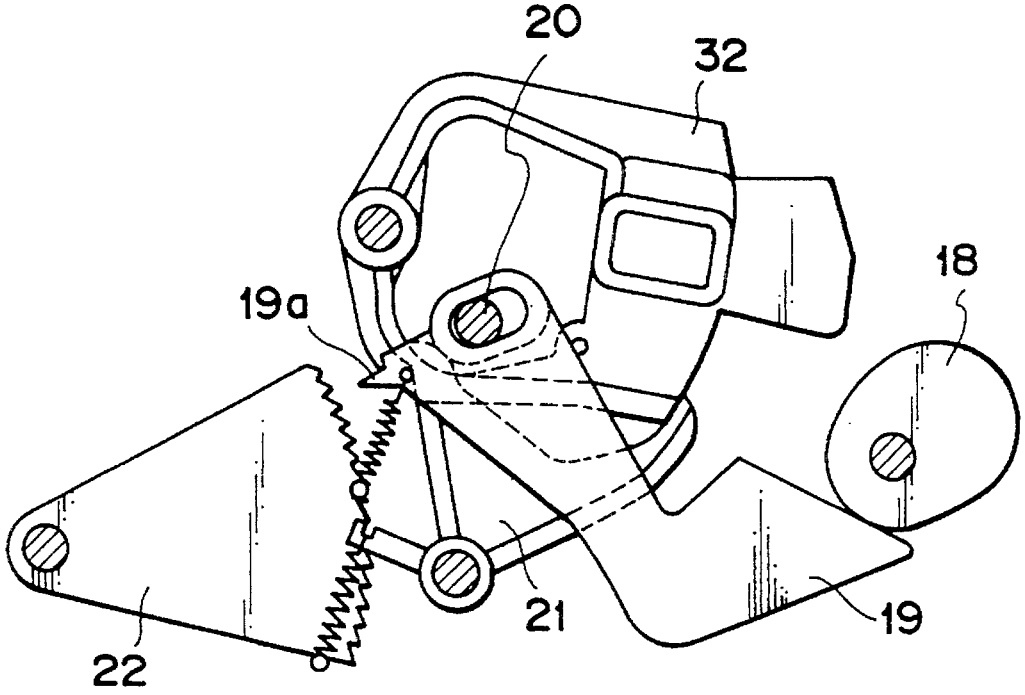
FIGS. 11A and 11B are front views showing a releasing condition of a lifter means of the apparatus of FIG. 1.
Figure 11B:
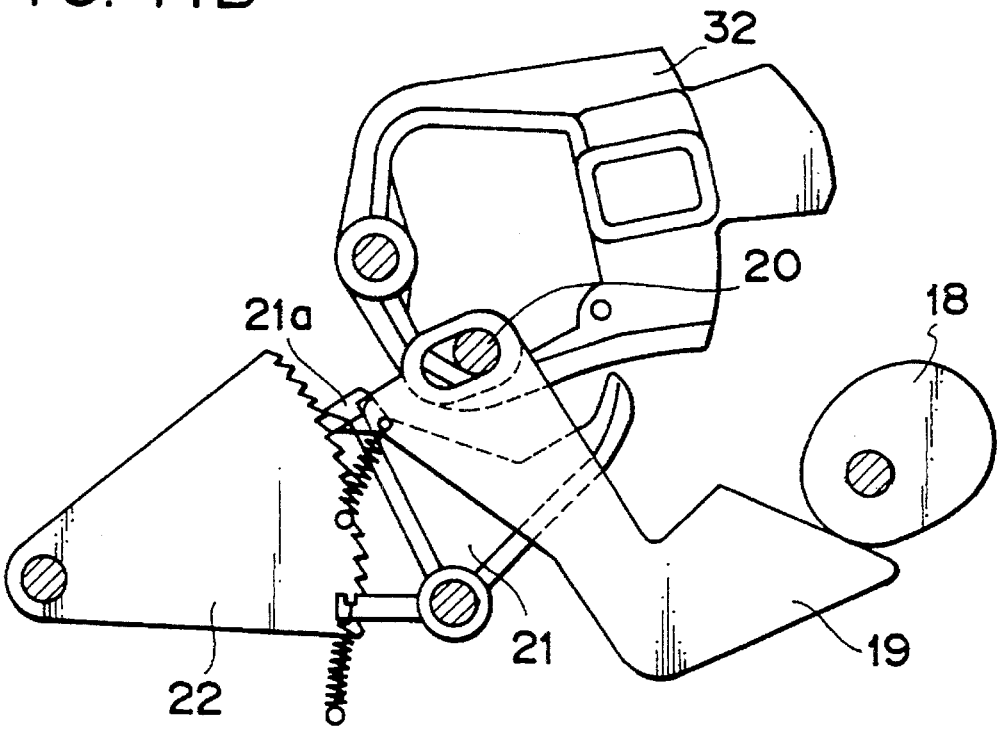
Figure 12:
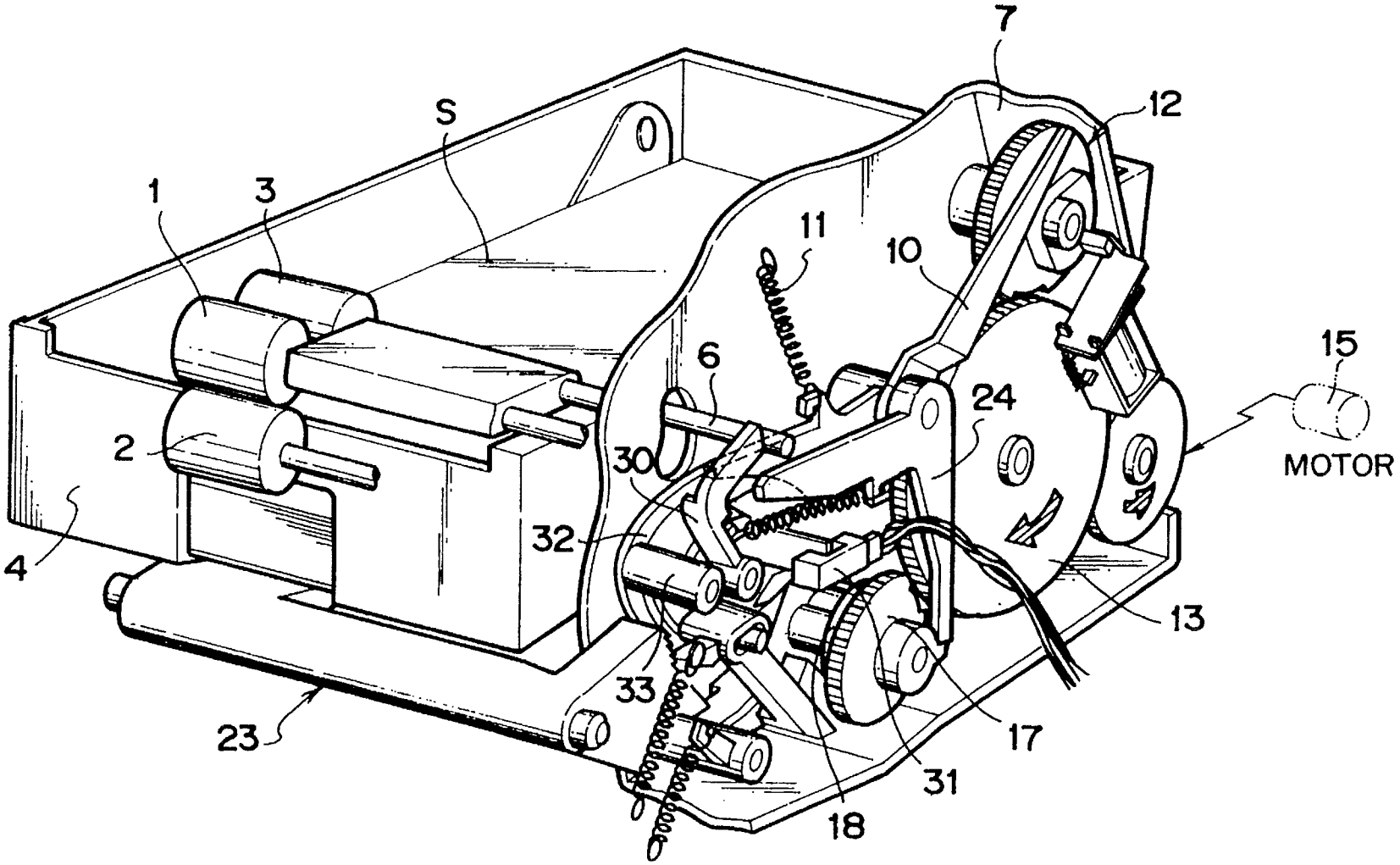
FIG. 12 is a perspective view of the apparatus of FIG. 1 showing a condition that the sheet cassette is mounted to the apparatus.

In this condition, the connecting lever 32 is fixed in the lowered position by the lock member 34. Consequently, as shown in FIG. 11A, both of the lift arm pawl 19 and the lift lock pawl 21 are spaced apart from the sector ratchet gear 22 of the lift-up member 23. Accordingly, the lift-up member 23 is in the lowermost position.

If the engagement between these pawls is not released, when any force acts on the sheet supply apparatus or on the lift-up member 23 in the condition that the sheet cassette 4 is dismounted from the apparatus, as shown in FIG. 7B, the lift-up member 23 is sometimes maintained in the lifted condition. In such a condition, a serious problem that the sheet cassette 4 cannot be mounted to the sheet supply apparatus will arise. However, by adopting the above-mentioned arrangement, such a problem can be avoided.

Figure 8A:
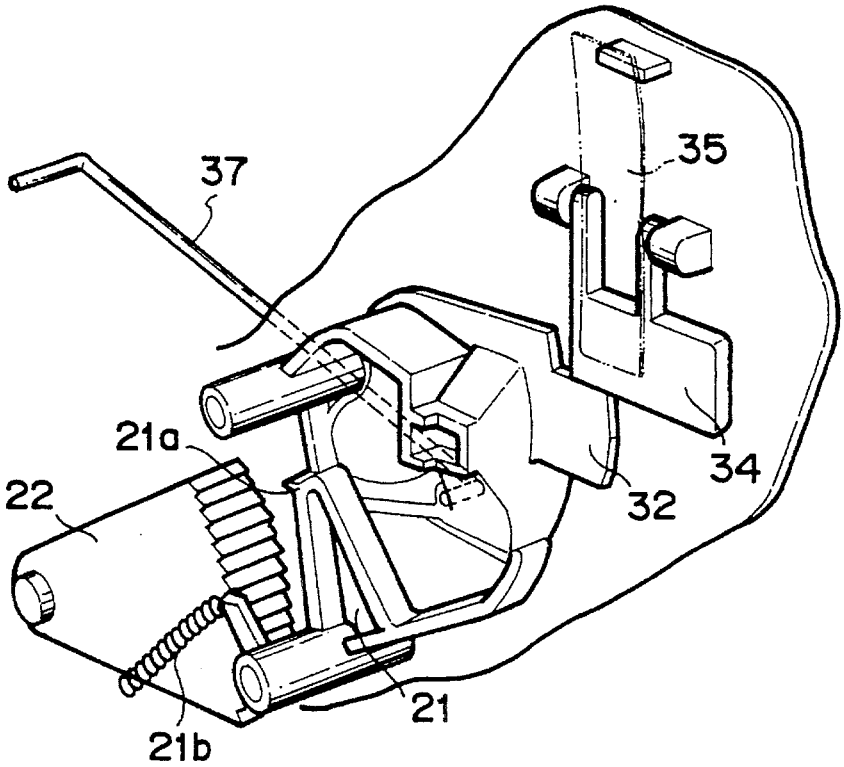
FIGS. 8A and 8B are perspective views showing the mounting operation of the sheet cassette associated with the apparatus of FIG. 1.

Further, as shown in FIGS. 3A and 8A, since the release rod 37 extending between the connecting lever 32 and the groove 7*c* is locked in the condition that the connecting lever 32 is lowered, the release rod is engaged by the protruded portion 50*a* to push the support member 50 downwardly. As a result, the retard roller 2 is separated from the feed roller 1, thereby releasing the separation pressure.

In this way, when the sheet cassette 4 is dismounted from the apparatus, since the connecting lever 32 is shifted to lower the lift-up member 23 and to release the separation pressure between the retard roller 2 and the feed roller 1, the sheet supply apparatus can be simplified, thereby making the apparatus compact and reducing the cost. Further, since the two operations can be effected by the single manipulation, the operability can be improved.

Further, by pushing the pick-up roller shaft 6 upwardly by the lift-up lever 10, the pick-up roller 3 is maintained in the uppermost position. Incidentally, as shown in FIG. 4A, the lever member 40 is also maintained in a position where the pick-up roller shaft 6 is lifted by the lever member. In this case, as shown in FIG. 7A, the connecting lever 32 is in the lowered position. Thus, since the photo-sensor 31 is not blocked by the flag 32*a*, the mounting of the sheet cassette 4 is not detected.

Next, a condition after the sheet cassette 4 is mounted will be explained.

After the sheet cassette 4 is mounted to the sheet supply apparatus, as shown in FIG. 7B, the lock member 34 is released by the projection 36, with the result that the connecting lever 32 is rocked upwardly by the ratch pawl 41 of the sheet cassette 4. Thus, the photo-sensor 31 is blocked by the flag 32*a*, thereby detecting the mounting of the sheet cassette 4.

Figure 8B:
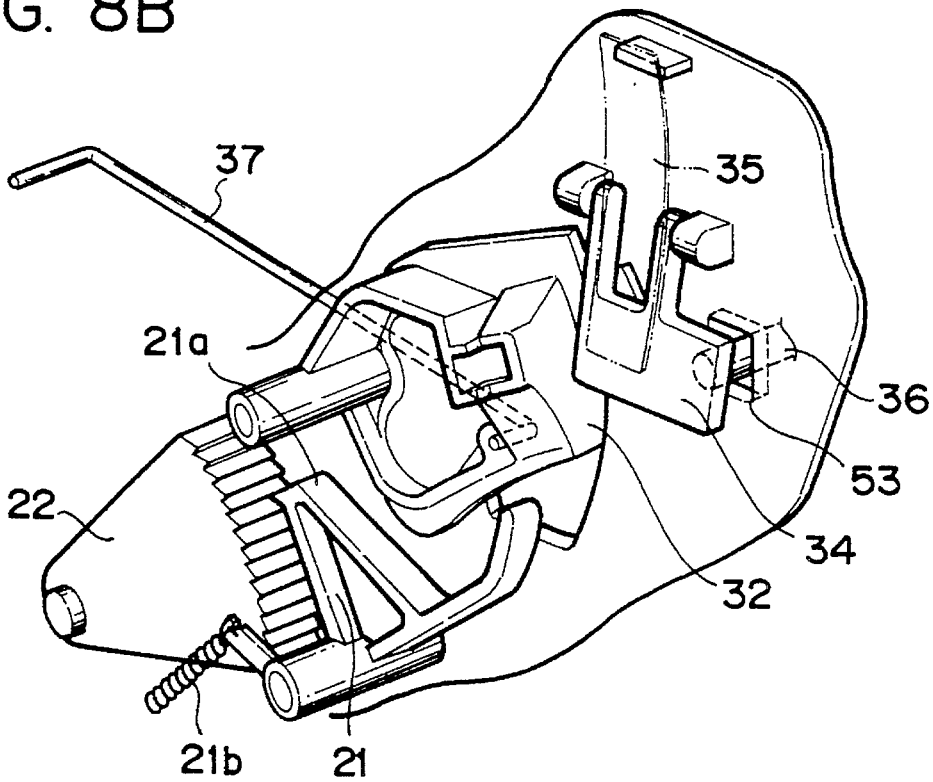

In this case, since the connecting lever 32 is lifted, as shown in FIGS. 3B and 8B, the release rod 37 is lifted to be disengaged from the protruded portion 50*a*. As a result, the support member 50 is shifted by the spring 52 to urge the retard roller 2 against the feed roller 1 with the predetermined separation pressure.

Figure 13:
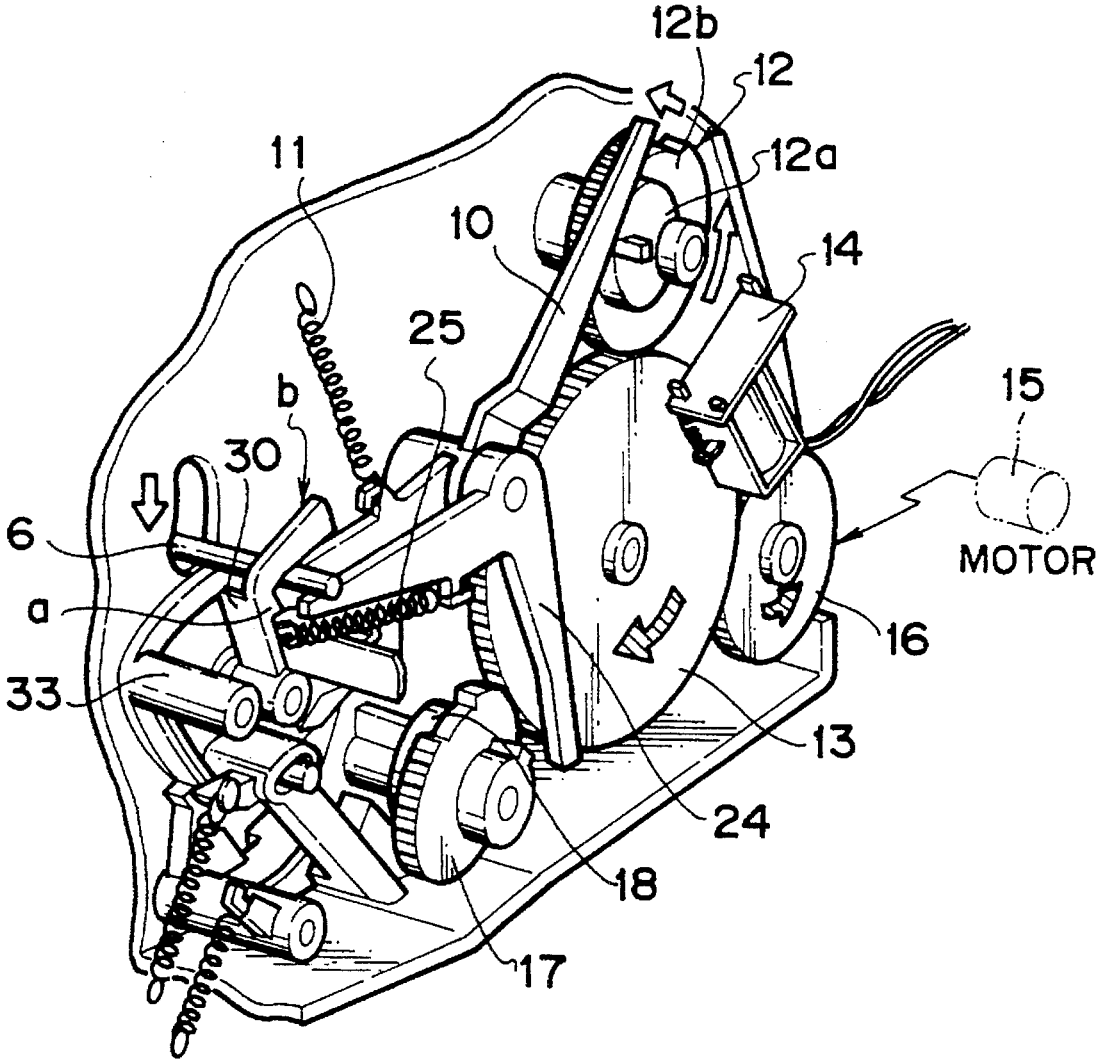
FIG. 13 is a perspective view showing a starting condition for bringing the apparatus of FIG. 1 to a stand-by condition.
Figure 14B:
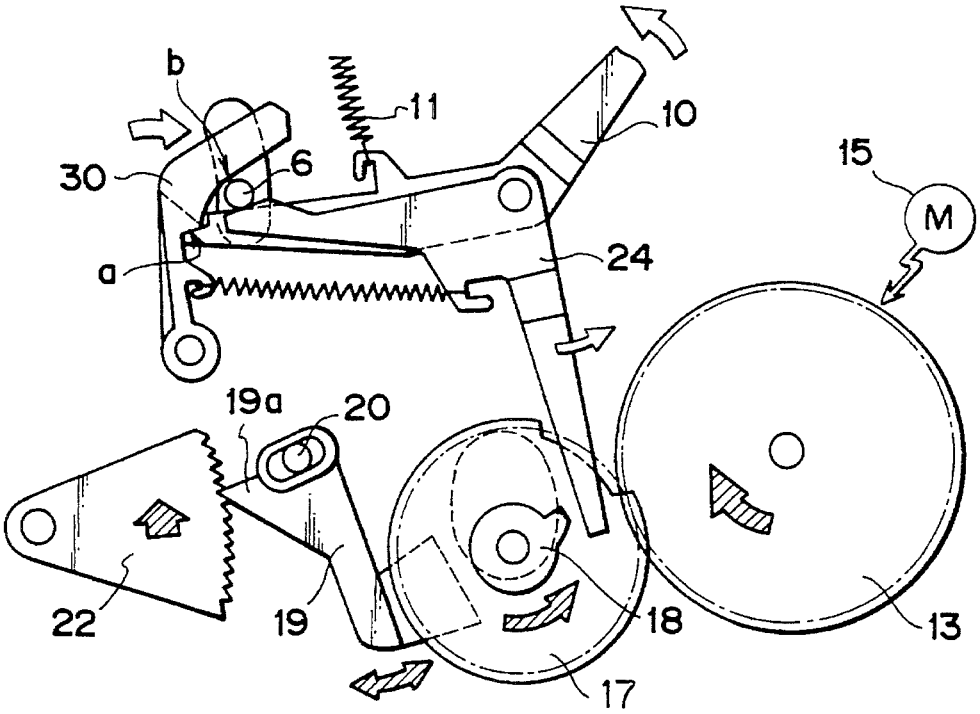

As shown in FIGS. 13 and 14B, when the mounting of the sheet cassette 4 is detected, the solenoid 14 is activated to release the regulation of rotation of the pick-up cam 12. As a result, the pick-up cam 12 is slightly rotated by the biasing means (not shown) to engage the gear portion 12*a* of the pick-up cam 12 by the drive gear 13, thereby transmitting the driving force (from the drive gear to the cam 12) to rotate the pick-up cam 12 in the direction shown by the arrow by one revolution. When the pick-up cam 12 is rotated by one revolution, the notched portion of the gear portion 12*a* is opposed to the drive gear 13, thereby interrupting the transmission of the driving force.

Then, when the pick-up cam 12 is rotated by one revolution, the lift-up lever 10 is lowered so that one end of the lift-up lever is caught by the pawl portion a of the pick-up lock lever 30, thereby locking the lift-up lever 10. In this case, the pick-up roller 3 is lowered by its own weight or by a biasing means (not shown) such as a spring. As a result, the pick-up roller shaft 6 is lowered to rotate the lifter trigger lever 24, with the result that the other end of the lifter trigger lever 24 is shifted to release the regulation of rotation of the lift-up cam 18. Incidentally, as shown in FIG. 4B, when the sheet cassette 4 is mounted, since the lock member 40 is lowered from the position for lifting the pick-up roller shaft 6, the lowering of the pick-up roller shaft 6 is not obstructed.

Figure 15:
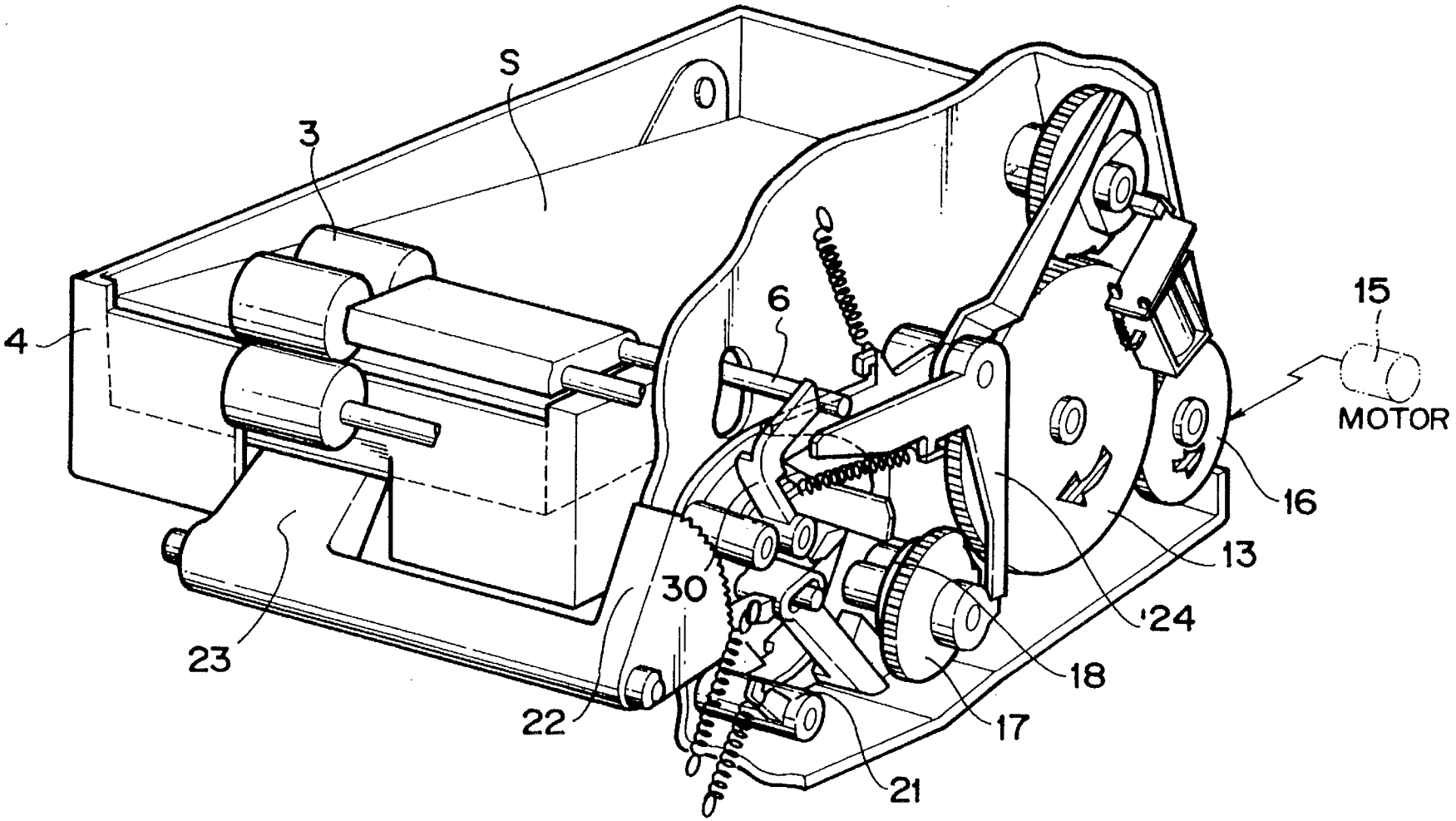
FIG. 15 is a perspective view showing an intermediate condition for bringing the apparatus of FIG. 1 to the stand-by condition.
Figure 16A:
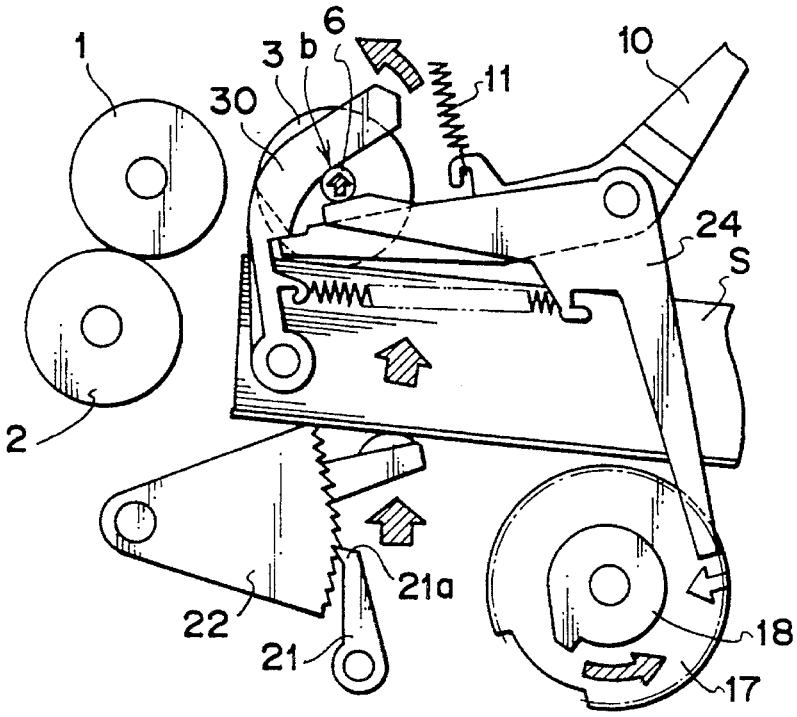
FIGS. 16A and 16B are enlarged views showing an operation for transferring the intermediate condition for bringing the apparatus of FIG. 1 to the stand-by condition, to the stand-by condition.

The released lift-up cam 18 engaged by the drive gear 13 to be rotated, thereby rocking the lift arm pawl 19. As a result, the sector ratchet gear 22 is rotated in the anti-clockwise direction to rotate the lift portion 23*a* of the lift-up member 23 in the same direction, thereby lifting the sheets in the sheet cassette 4 (condition shown in FIGS. 15 and 16A).

Figure 16B:
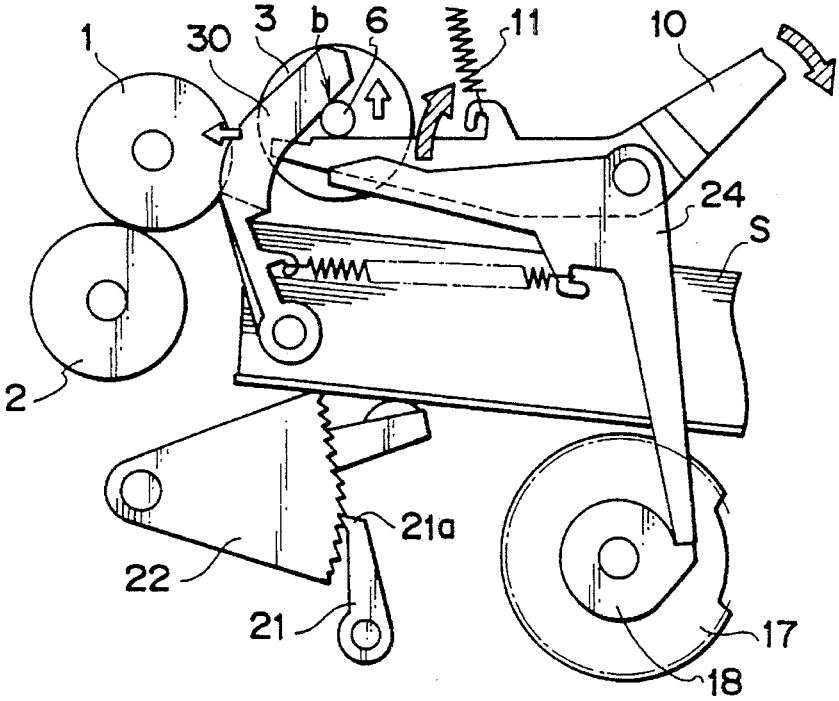

As the sheets are lifted, the pick-up roller 3 is also lifted. When the pick-up roller 3 is lifted to a predetermined height position, the hood portion b of the pick-up lock lever 30 is lifted to rotate the pick-up lock lever 30 in the anti-clockwise direction, thereby unlocking the lift-up lever 10. As soon as the lift-up lever 10 is unlocked, the lift-up lever 10 causes the pick-up roller 3 to lift to the uppermost position under the action of the spring 11, thereby providing a stand-by condition for permitting the supply of the sheet (condition shown in FIG. 16B).

In this way, in the sheet supply apparatus of the type wherein the pick-up roller 3 is lowered and lifted by the locking and unlocking operations for the pick-up roller 3 and the sheets are lifted in accordance with the position of the pick-up roller 3, the sheets can be lifted up positively and swiftly when the sheet cassette 4 is mounted to the apparatus.

Figure 17:
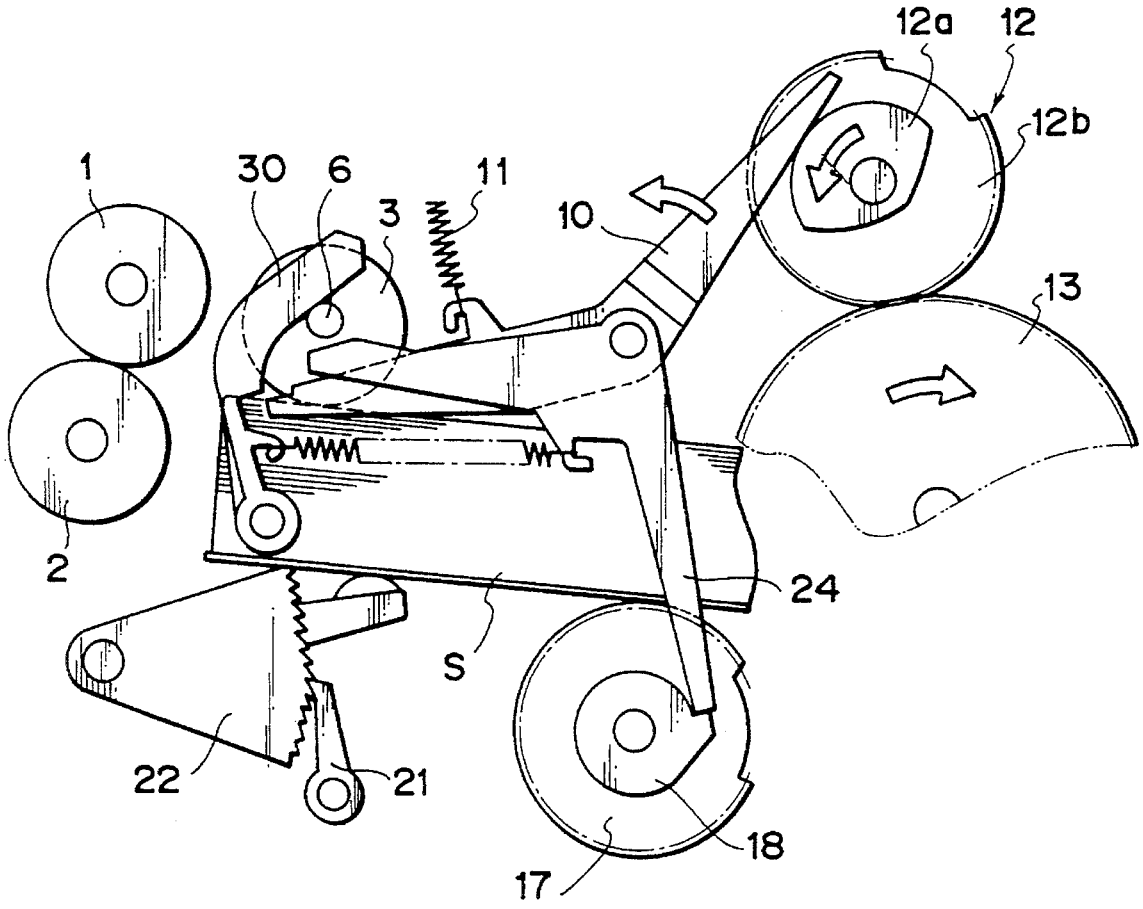
FIG. 17 is an enlarged view of main portions of the apparatus of FIG. 1 showing a sheet supplying condition.
Figure 18:
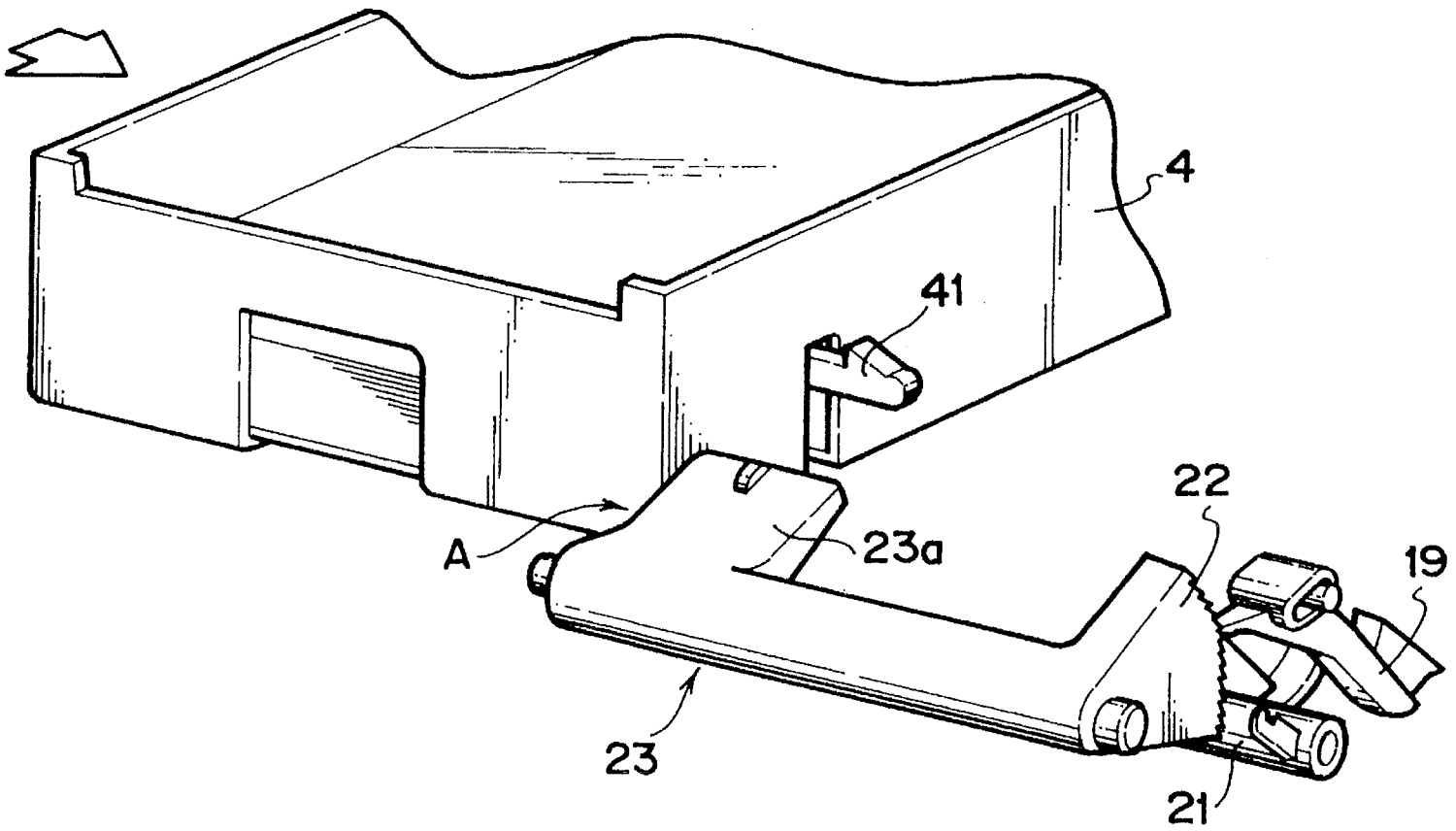
FIG. 18 is a perspective view showing a condition that the lift-up member is not lowered in the apparatus of FIG. 1.

Thereafter, as shown in FIG. 17, in response to a sheet supply start signal, the solenoid 14 is activated to rotate the pick-up cam 12, with the result that the lift-up lever 10 is rocked to lower the pick-up roller shaft 6. In this case, since the pick-up roller 3 is not lowered below a height of an uppermost surface of the sheet stack S, the movement of the pick-up lock lever 30 is regulated by the pick-up roller shaft 6, so that the pick-up lock lever 30 is not further rotated in the clockwise direction from the position shown in FIG. 17. Accordingly, when the lift-up lever 10 is in the lowered position, it is not locked by the pick-up lock lever 30, and, thus, the pick-up roller shaft 6 positioned at the lowered position is not fixed.

That is to say, the pick-up roller 3 is abutted against the uppermost surface of the sheet stack S for a time duration determined by the configuration and angular velocity of the pick-up cam 12, and, thereafter, the pick-up roller 3 is separated from the sheet stack and is lifted. Meanwhile, the feed roller 1, retard roller 2 and pick-up roller 3 are rotated by the stepping motor (not shown), thereby separating and supplying the sheets S one by one from the sheet cassette 4.

As the uppermost surface of the sheet stack is lowered due to the continuous supply of sheets, one end of the lifter trigger lever 24 is pushed upwardly by the pick-up roller shaft 6 to release the regulation of rotation of the lift-up cam 18. As a result, whenever the lift-up cam 18 is rotated by one revolution, the sector ratchet gear 22 is rotated by an amount corresponding to one tooth, so that the sheet stack S is lifted by the lift portion 23*a* of the lift-up member 23. By repeating such movements, the height of the upper surface of the sheet stack is kept substantially constant. In this way, since the lift-up cam 18 is rotated only when the lifting of the sheet stack S is required, the lift-up cam 18 and the lift arm pawl 19 are not slidingly contacted with each other excessively, thereby preventing the wear and noise. That is to say, if the lift-up cam 18 is always rotated and the lift-up pawl 19 is separated from the sector ratchet gear 22 in response to the lifting of the sheet stack S, the lift-up cam 18 is not frequently separated from the lift-up pawl 19 adequately to maintain the contact between these elements, thereby wearing such elements or generating the undue noise. However, as is in the present invention, by rotating the lift-up cam 18 only when the lifting of the sheet stack is required, such a problem can be solved.

Due to the above-mentioned series of operations, the pick-up roller 3 is abutted against the sheet stack S only when the sheet S is supplied from the sheet cassette 4. When the sheet is not supplied, the pick-up roller 3 is separated from the sheet stack S, with the result that the double-feed of the sheets can be prevented effectively and positively by the feed roller 1 and the retard roller 2.

Now, the stand-by condition (i.e. the setting of the height of the upper surface of the sheet stack before a first sheet is supplied and after the sheet cassette 4 is mounted to the sheet supply apparatus) will be explained.

Figure 19:
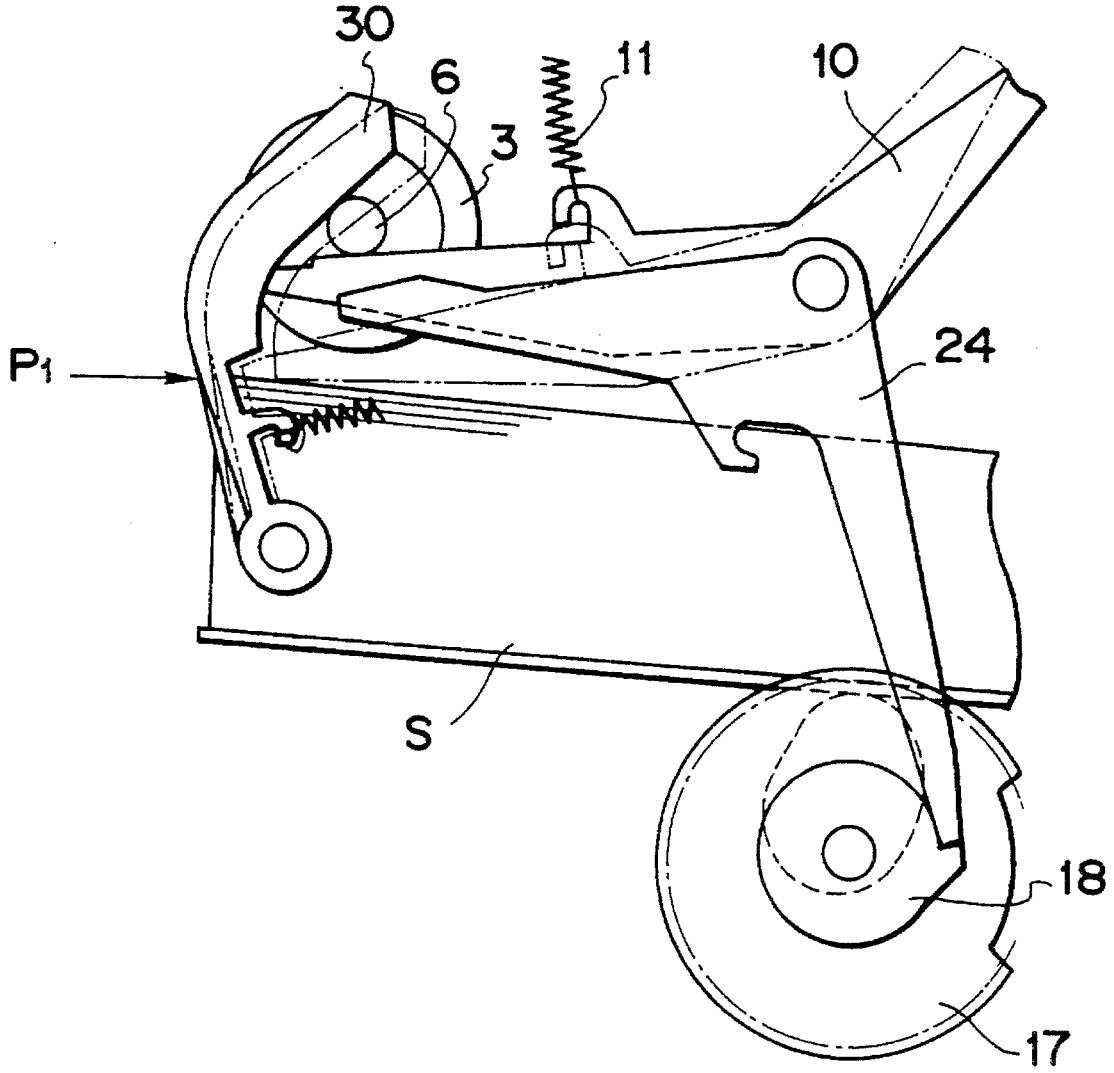
FIG. 19 is an enlarged view showing the stand-by condition of the apparatus of FIG. 1.

When the sheet cassette 4 is mounted, the sheet stack is firstly lifted by the lifter mechanism and the lift-up lever 10 is released by the pick-up lock lever 30, with the result that the pick-up roller 3 is shifted upwardly by the lift-up lever 10 via the pick-up roller shaft 6. During the upward shifting movement of the pick-up roller, the lifter trigger lever 24 is shifted to the position for regulating the rotation of the lift-up cam 18, thereby stopping the lifting movement of the sheet stack S effected by the lifter mechanism. That is to say, the position of the upper surface of the sheet stack is determined by the timing for releasing the lift-up lever 10 by means of the pick-up lock lever 30. As shown in FIG. 19, this releasing timing can be appropriately set by the configuration of the pick-up lock lever 30. In the stand-by condition, the height of the uppermost surface of the sheet stack is designated by $P_1$.

Figure 20:
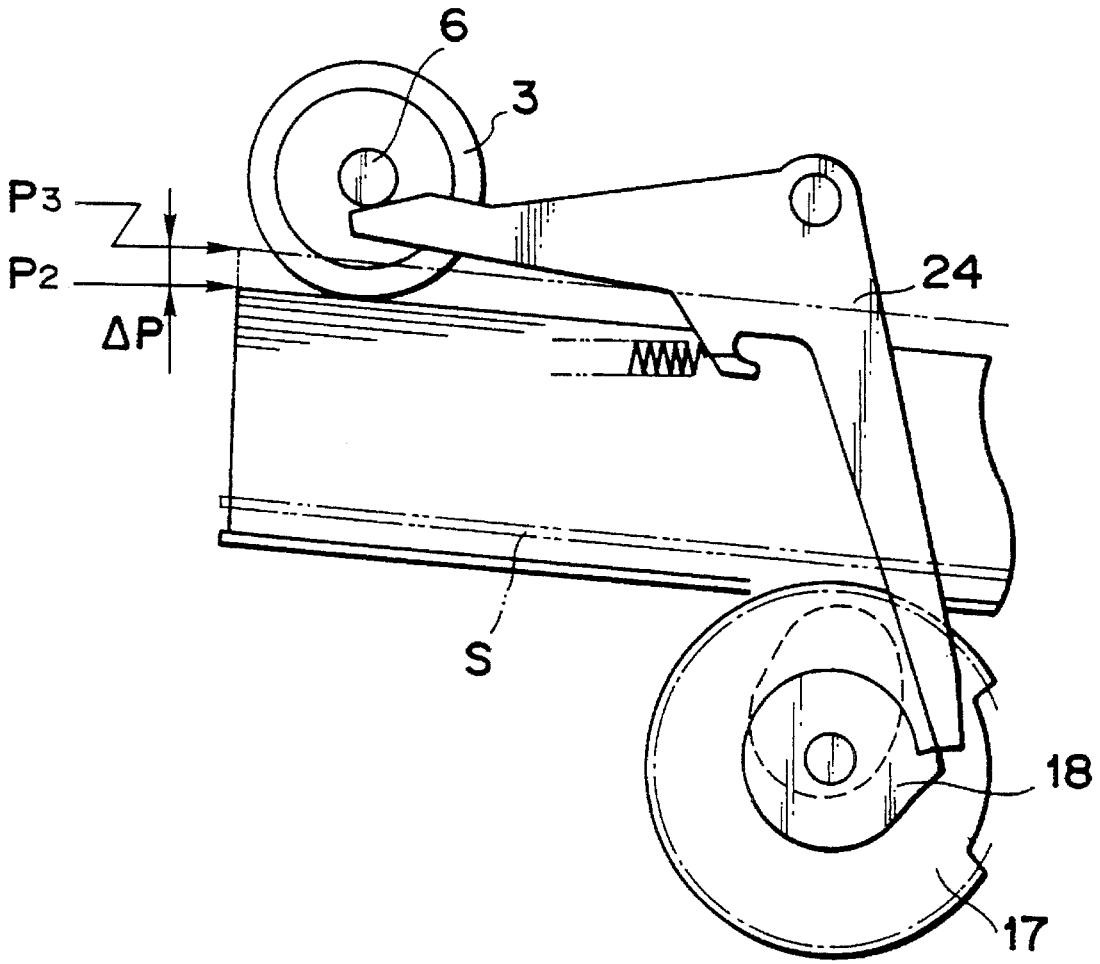
FIG. 20 is a view showing a shifting range of a height of the upper surface of the sheet shifted by the lifter means of the apparatus of FIG. 1.

Then, as mentioned above, during the continuous supply of the sheets, when the height position of the uppermost surface of the sheet stack S reaches $P_2$ as an amount of the sheets in the cassette is decreased, the lifter trigger lever 24 is shifted from the position for regulating the rotation of the lift-up cam 18, thereby releasing the regulation of rotation of the lift-up cam. As a result, the lift-up cam 18 is rotated to rock the lift arm pawl 19, thereby rotating the sector ratchet gear 22 in the anti-clockwise direction by the amount corresponding to one tooth of the ratchet to cause the lift-up member 23 to lift the sheet stack S. When a shifting amount of the sheet stack S corresponding to one tooth of the ratchet is Δp and the height of the uppermost surface of the shifted sheet stack is $P_3$ (FIG. 20), it is ideal that the setting of the position of the uppermost surface of the sheet stack satisfies the following relation:

$$P_2<P_1<P_3\ (=P_2+\Delta P)$$

Incidentally, practically, since the adequate advantage can be obtained even when $P_1$ is substantially the same as $P_2$ it was found, from the test, that the following relation may be satisfied:

$(P_2-5\text{ mm})<P_1<P_3+5\text{ mm}\ (=P_2+\Delta P+5\text{ mm})$

By setting the height $P_1$ of the uppermost surface of the sheet stack in the stand-by condition in this way, the optimum sheet supply can be achieved.

Figure 21A:
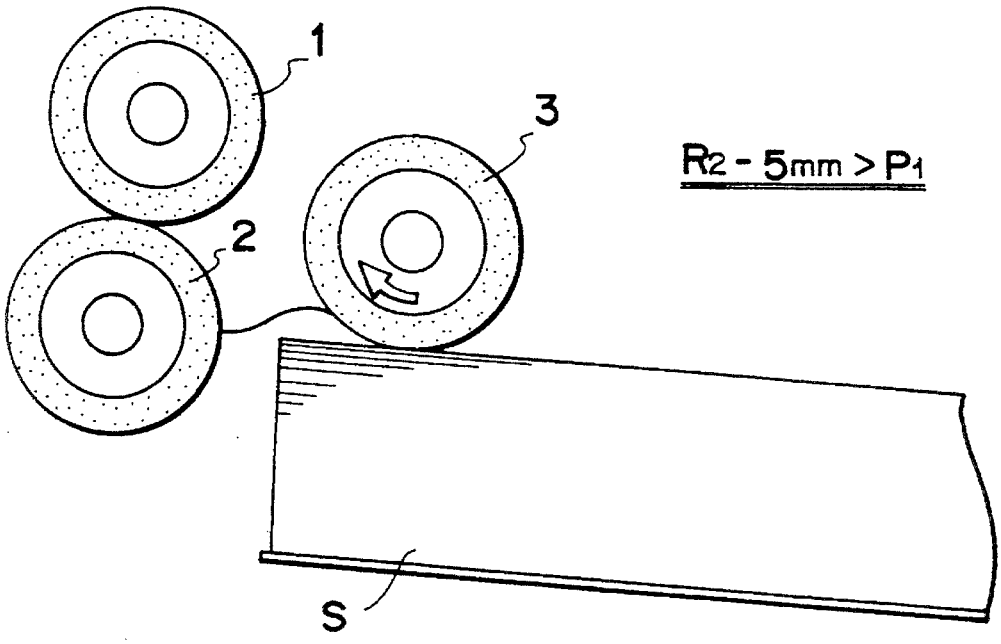
FIGS. 21A and 21B are views showing a condition that poor sheet supply occurs due to the poor positioning of the height of the upper surface of the sheet in the stand-by condition of the apparatus of FIG. 1.

Now, the case where such setting is not performed will be explained. For example, if $(P_2-5\text{ mm})>P_1$, as shown in FIG. 21A, in the stand-by condition after the sheet cassette 4 is mounted, the position of the uppermost surface of the sheet stack becomes too low, with the result that the sheet fed out by the pick-up roller 3 is struck against the retard roller (separation means) 2, thereby causing the poor supply such as sheet jam.

Figure 21B:
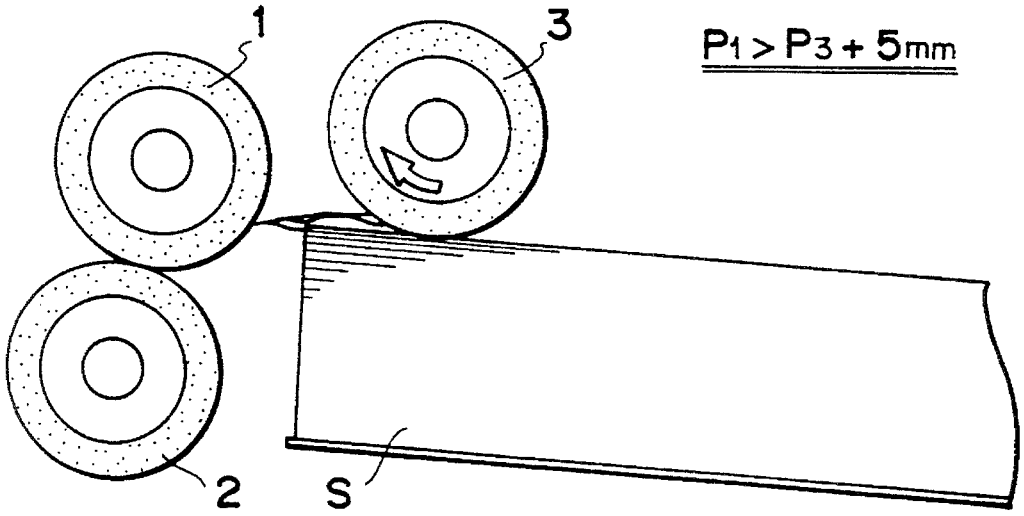

Further, if $P_1>(P_3+5\text{ mm})$, as shown in FIG. 21B, the position of the uppermost surface of the sheet stack in the stand-by condition becomes too high, with the result that the sheet fed out by the pick-up roller is struck against the feed roller (separation means) 1, thereby causing the poor supply such as sheet jam. Accordingly, in order to avoid such problems, the optimum setting of the height of the uppermost surface of the sheet stack is required.

When the sheet supplying operation is effected in the optimum condition set in this way, the double-feed of the sheets S can be prevented by the retard roller 2 to which a driving torque in a reverse direction is applied. However, the sheet which is not supplied due to the prevention of the double-feed is sometimes pinched between the feed roller 1 and the retard roller 2. In this condition, if the sheet cassette 4 is retracted from the sheet supply apparatus, the pinched sheet S will be broken.

To avoid this, in the illustrated embodiment, by manipulating the grip 48 of the sheet cassette 4, the ratch pawl 41 of the sheet cassette 4 is lowered, thereby lowering the connecting lever 32, with the result that, as shown in FIG. 3A, the retard roller 2 is separated from the feed roller 1 via the release rod 37, thereby releasing the separation pressure. At the same time, as shown in FIG. 11A, the lift arm pawl 19 and the lift lock pawl 21 are separated from the sector ratchet gear 22, so that the lift-up member 23 is lowered to lower the upper surface of the sheet stack. As a result, the sheet cassette 4 can be retracted from the sheet supply apparatus. In this case, since the retard roller 2 is separated from the feed roller 1 to release the separation pressure, the pinched sheet is dropped into the sheet cassette 4 so that the sheet does not obstruct the retraction of the sheet cassette.

Further, in the condition that the sheet cassette 4 is dismounted from the sheet supply apparatus, as shown in FIG. 3A, since the separation between the retard roller 2 and the feed roller 1 is maintained, even when the dismounted sheet cassette is left as it is for a long time, permanent deformation of the feed roller 1 and the retard roller 2 can be prevented.

Next, the retraction of the sheet cassette 4 from the sheet supply apparatus which is effected, for example, when new sheets are to be replenished into the sheet cassette will be explained. When the sheet cassette 4 is retracted from the sheet supply apparatus, by manipulating the grip 48 of the sheet cassette 4, the ratch pawl 41 of the sheet cassette 4 is lowered, thereby lowering the connecting lever 32 to regulate the rotation of the lift-up cam 18. At the same time, the lift arm pawl 19 and the lift lock pawl 21 are separated from the sector ratchet gear 22, so that the lift-upper member 23 is lowered to lower the upper surface of the sheet stack. As a result, the sheet cassette 4 can be retracted from the sheet supply apparatus.

During the sheet supplying operation, for example, if the power source of the sheet supply apparatus is erroneously turned OFF to stop the main motor 15, the pick-up cam 12 will be stopped while engaging by the drive gear 13. In such a case, the lift-up lever 10 may be stopped at the lowermost position in accordance with the phase of the pick-up cam 12. In this case, since the pick-up roller 2 is positioned at the lowermost position within the sheet cassette 4, it is very difficult to retract the sheet cassette 4 from the sheet supply apparatus.

However, also in this case, as mentioned above, under the action of the lever member 40 for lifting and lowering the pick-up roller 2 in synchronous with the mounting and dismounting movements of the sheet cassette 4, when the sheet cassette 4 is slightly retracted, the pick-up roller 2 is lifted, thereby facilitating the retraction of the sheet cassette 4.

Figure 22A:
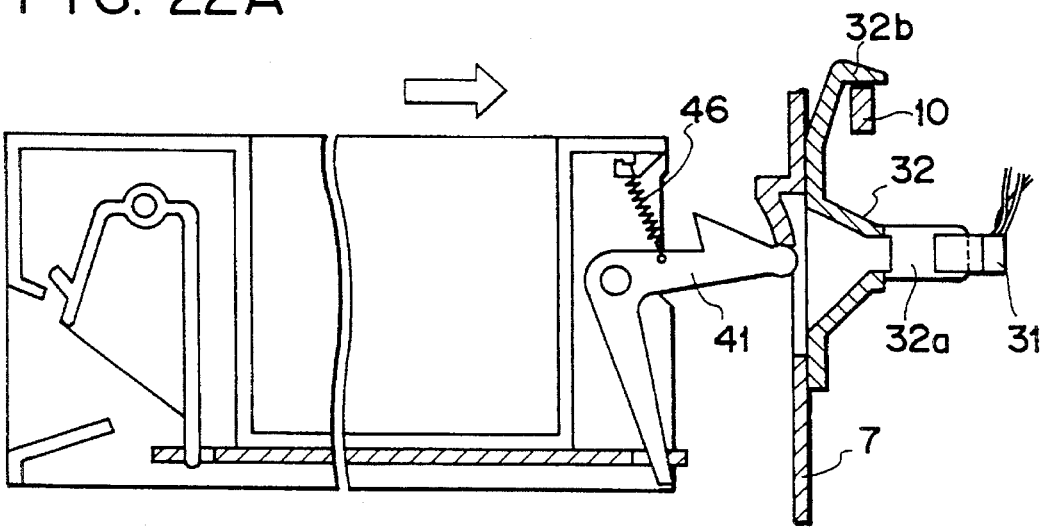
FIGS. 22A to 22C are sectional views of a sheet supply apparatus according to another embodiment of the present invention in a sheet cassette mounted condition.
Figure 22B:
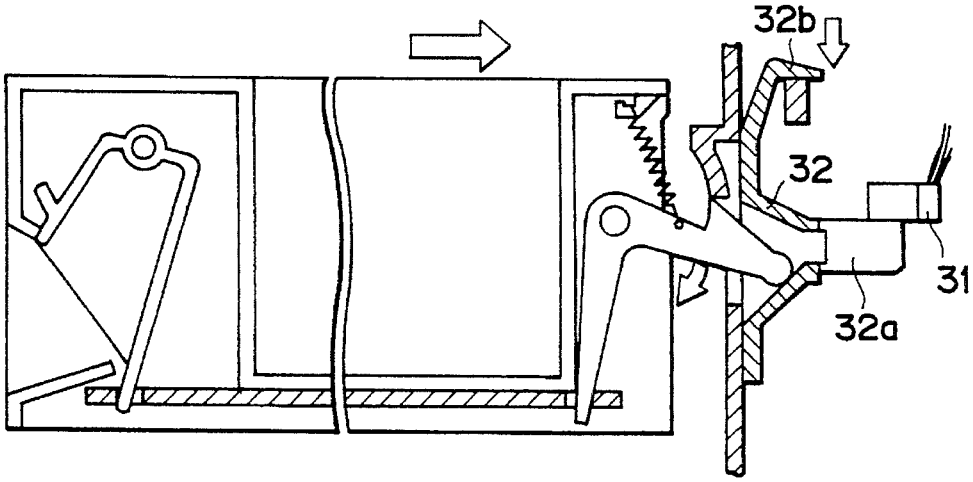
Figure 22C:
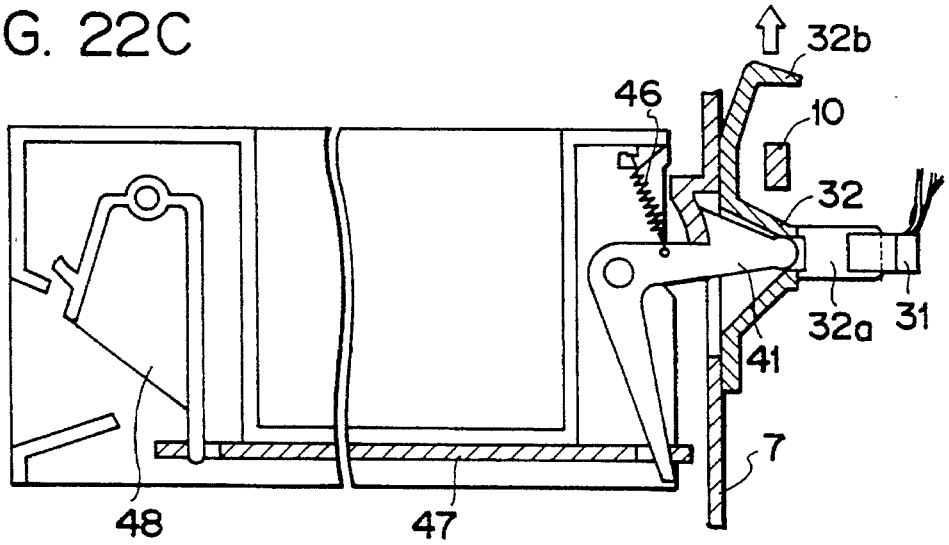

In the illustrated embodiment, while the mounting of the sheet cassette 4 was detected by the photo-sensor 31 and the solenoid was activated on the basis of the detection result to achieve the stand-by condition, the stand-by condition may be achieved by an arrangement shown in FIGS. 22A to 22C.

In such an arrangement, as shown in FIG. 22B, when the ratch pawl 41 of the sheet cassette 4 is engaged by the frame 7, the ratch pawl 41 is rotated to push the connecting lever 32 downwardly in FIG. 22B. In this case, by pulling the lift-up lever 10 downwardly in FIG. 22B by the engagement portion 32*b* of the connecting lever 32, the pick-up lever 10 is fixed by the pick-up lock lever 30. In this fixed condition, the lift arm pawl 19 is rocked and the sector ratchet gear 22 is rotated in the anti-clockwise direction, with the result that the sheet stack in the sheet cassette is lifted by the lift-up member 23. The further operations are the same as those of the aforementioned embodiment. Incidentally, after the ratch pawl 41 is fitted into the connecting lever 32, since the connecting lever 32 is lifted, the upward and downward movements of the lift-up lever 10 are not obstructed by the engagement portion 32*b* (condition shown in FIG. 22C).

In this way, in the arrangement wherein the lift-up lever 10 is fixed by the lift-up lock lever 30 in synchronous with the mounting movement of the sheet cassette 4 without activating the solenoid 14, it is possible to achieve the stand-by condition without using the photo-sensor 31 for detecting the mounting of the sheet cassette 4 as shown in FIGS. 22A to 22C.

Figure 23:
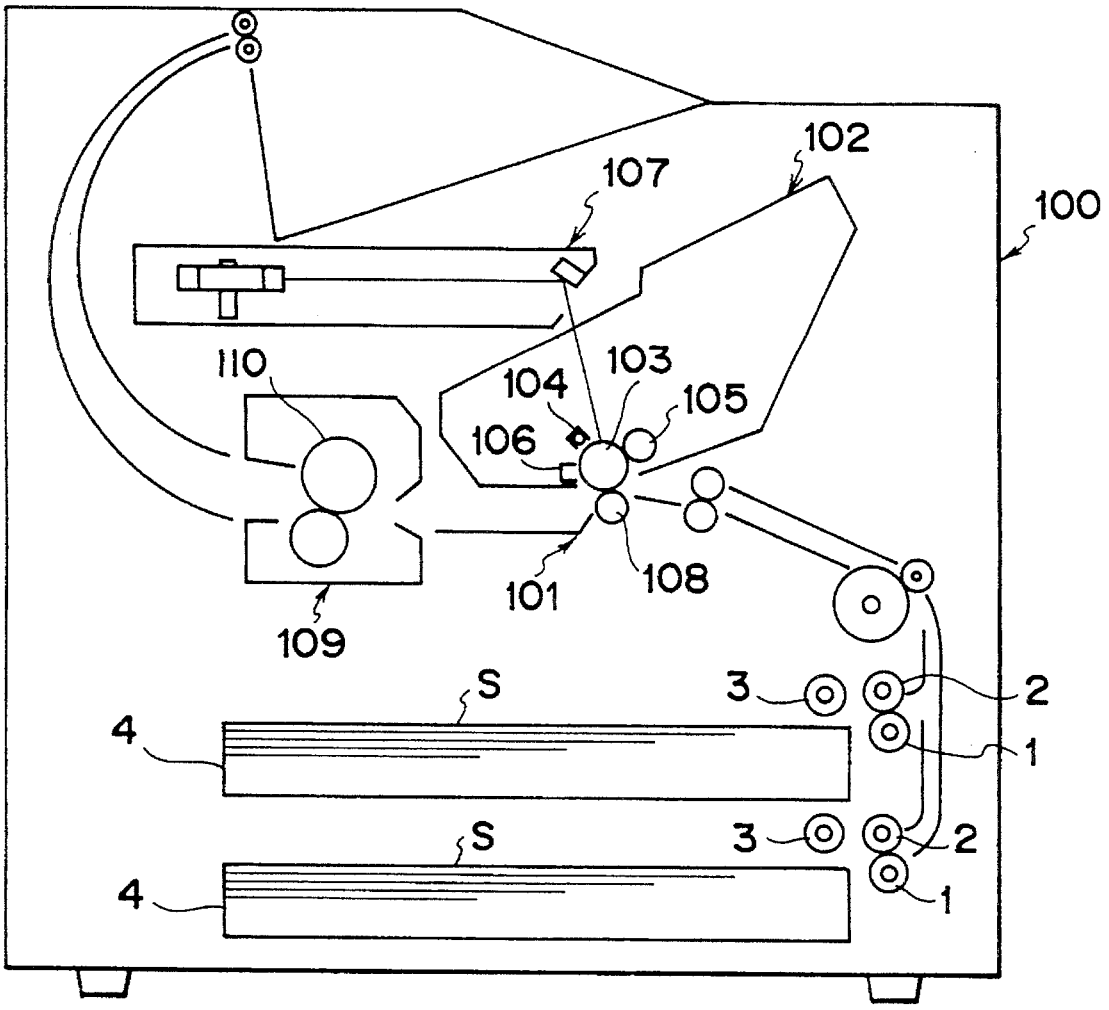
FIG. 23 is an elevational sectional view of an image forming apparatus incorporating the sheet supply apparatus of the present invention therein, according to a preferred embodiment of the present invention.

Next, an image forming apparatus having the above-mentioned sheet supply apparatus will be explained with reference to FIG. 23. Incidentally, in this embodiment, as an image forming apparatus, a laser beam printer will be described.

A sheet cassette 4 is of front loading type which can be mounted to the laser beam printer 100 from a front side thereof, and sheets S stacked in the sheet cassette 4 are supplied along a direction perpendicular to a mounting direction of the sheet cassette 4.

The sheet supplied from the sheet cassette 4 passes through an image forming portion 101 and a fixing portion 109 (described later) and then is discharged out of the printer. The image forming portion 101 includes a process cartridge 102 which is removable with respect to the printer 100, which process cartridge comprises an electrophotographic photosensitive drum (image bearing member) 103, a charge means 104 for charging a surface of the photosensitive drum 103, a developing means 105 for forming a toner image on the photosensitive drum 103, and a cleaning means 106 for removing the residual toner remaining on the surface of the photosensitive drum 103. The photosensitive drum 103 is exposed by image light emitted from a scanner portion 107 in response to an image signal.

Further, the image forming portion also includes a transfer roller 108 for transferring the toner image formed on the surface of the photosensitive drum 103 onto the sheet. The transfer roller 108 serves to urge the sheet supplied from the sheet cassette 4 against the photosensitive drum 103. By applying voltage having polarity opposite to that of the toner image to the transfer roller 108, the toner image formed on the surface of the photosensitive drum 103 onto the sheet.

The sheet to which the toner image was transferred by the transfer roller 108 is sent to the fixing portion 109 which includes a fixing roller 110 for applying heat and pressure to the sheet to fix the toner image onto the sheet. In this way, the toner image is transferred onto the sheet supplied from the sheet cassette 4 by means of the process cartridge 102 and the transfer roller 108, and the toner image is then fixed to the sheet by the fixing portion 109, and then the sheet is discharged out of the printer.

Incidentally, the present invention is not limited to the aforementioned embodiment. For example, in the illustrated embodiment, while the other end of the release rod 37 was supported by the frame 7, it may be directly supported by the support member 50. Further, when the lock member 34 is released by the sheet cassette 4, the support member 50 may be directly pushed donwardly by the connecting lever 32 without through the release rod 37, thereby releasing the separation pressure. In this case, the number of parts can be reduced to make the apparatus inexpensive. Further, while the release rod 37 was formed from the metal wire, the release rod may be made of other material.

Further, in the illustrated embodiment, while an example that the retard roller is used as the separation means was explained, any friction separation means (for example, a friction pad) abutted against the feed roller to separate the sheets between the feed roller and the separation means may be used.

As fully described above, since the urging contact between the friction separation means and the sheet supply means is released in synchronous with the mounting and dismounting movements of the sheet supporting means and the released condition is maintained by the lock means, any adjustment by means of two springs as in the conventional case is not required, thereby simplifying the construction of the apparatus, improving the assembling feature and making the apparatus inexpensive. Further, since the sheet cassette may be mounted in opposition to the urging force between the friction separation means and the sheet supply means, the excessive operating force is not required, thereby improving the operability.

Further, by combining the above arrangement with the lifter mechanism for lifting the sheet supporting means to the predetermined position, the urging contact between the friction separation means and the sheet supply means, and the lifting movement of the lifter mechanism can be effected simultaneously in synchronous with the mounting and dismounting operations of the sheet supporting means, thereby simplifying the apparatus to make the apparatus compact and to reduce the cost, and improving the operability.

Figure 24:
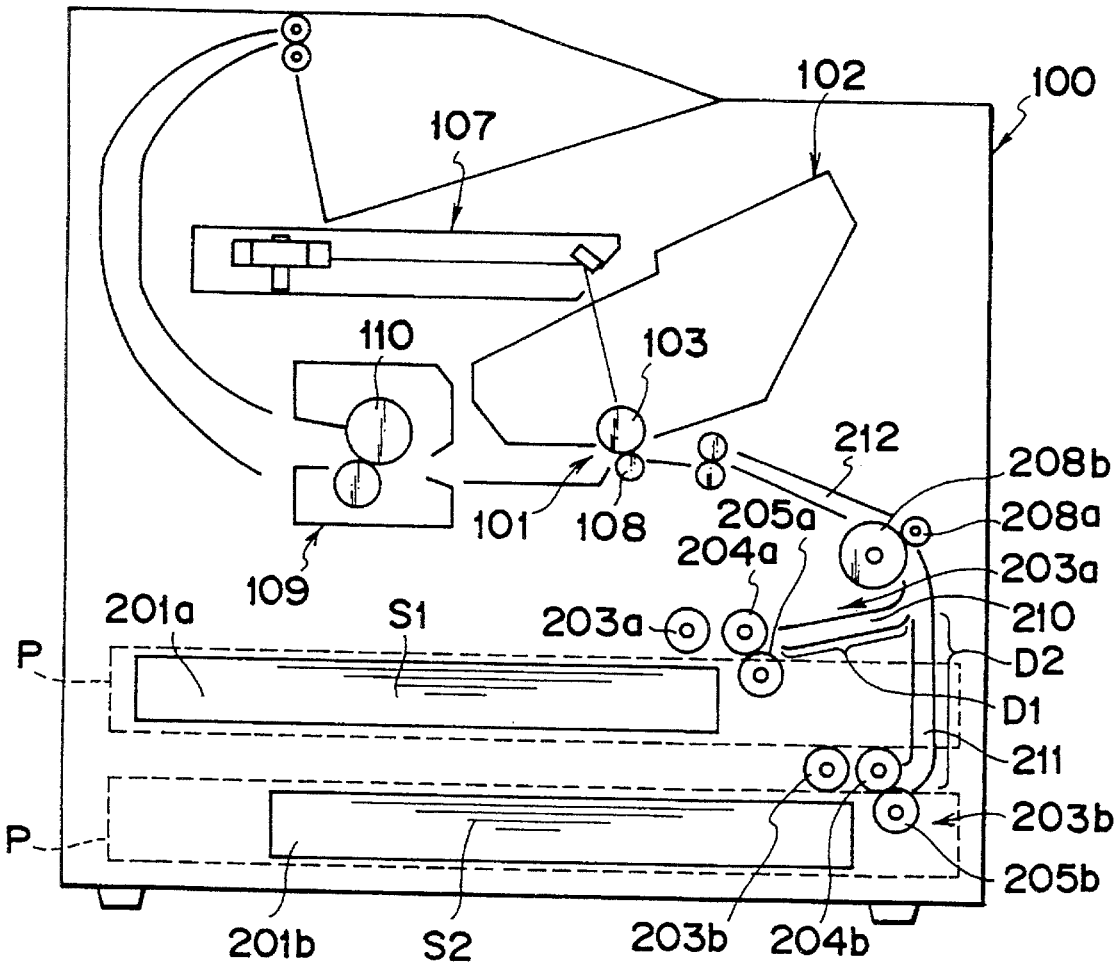
FIG. 24 is an elevational sectional view of an image forming apparatus according to another embodiment of the pre sent invention.
Figure 25:
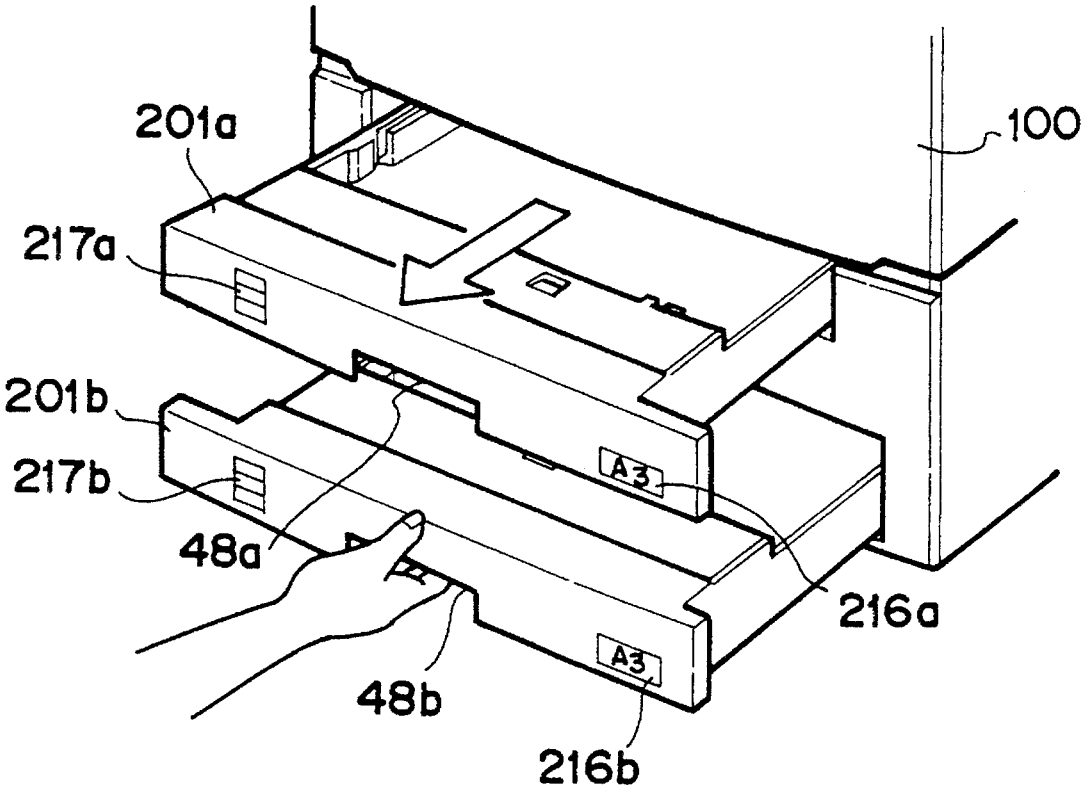
FIG. 25 is a perspective view of the apparatus of FIG. 24 showing a condition that a cassette is retracted.

FIGS. 24 and 25 shows a laser beam printer according to another embodiment of the present invention having the sheet supply apparatus of the present invention. Now, this laser beam printer will be explained.

As shown in FIG. 24, cassettes 201*a*, 201*b* containing the sheets S1 and S2, respectively, are arranged in an overlapped relation along a vertical direction at a lower portion of the printer, and sheet supply portions 203*a*, 203*b* are provided in association with the cassettes 201*a*, 201*b*.

The sheet supply portions 203*a*, 203*b* are the same as that described above and comprise pick-up rollers 203*a*, 203*b* abutted against the upper surface s of the sheet stacks S1, S2 contained in the cassettes 201*a*, 201*b* to feed out the sheets, and feed rollers 204*a*, 204*b* and retard rollers 205*a*, 205*b* (pairs of separation rollers) for separating the sheets S1, S2 fed out by the pick-up rollers 203*a*, 203*b* one by one.

The sheet S1 supplied from the cassette 201*a* by the sheet supply portion 203*a* is conveyed along a convey path 210, and the sheet S2 supplied from the cassette 201*b* by the sheet supply portion 203*b* is conveyed along a convey path 211. The convey paths 210, 211 are joined to each other on the way so that the sheets S1, S2 conveyed through the convey paths 210, 211 are fed through a common convey path 212 after the sheets pass through the junction. A pair of convey rollers 208*a*, 208*b* for sending the sheets S1, S2 supplied from the cassettes 201*a*, 201*b* to the image forming portion 101 are arranged in the common convey path 212.

The lower cassette 201*b* and the sheet supply portion 203*b* are offset toward a downstream side (right in FIG. 24) of the upper cassette 201*a* and the sheet supply portion 203*a* in a sheet conveying direction by a predetermined amount so that a distance D1 from the upper sheet supply portion 203*a* to the junction between the convey paths 210, 211 is substantially equal to a distance D2 from the lower sheet supply portion 203*b* to the junction.

As shown in FIG. 25, the cassettes 201*a*, 201*b* are arranged in such a manner that they can be mounted to and dismounted from the printer along a direction perpendicular to the sheet conveying direction, so that an operator can replenish new sheets at a front side (operating side) of the printer (front loading type).

Outer profiles of the cassettes 201*a*, 201*b* (configurations shown by the broken lines P in FIG. 24) looked at from the front side of the printer are the same as each other, and these cassettes are aligned with each other in a vertical direction. Further, since size indication portions 216*a*, 216*b* for indicating the sizes of the sheets S1, S2 contained in the cassettes 201*a*, 201*b*, remaining amount indication portions 217*a*, 217*b* for indicating remaining amounts of the sheets S1, S2, and grip portions 48*a*, 48*b* gripped by the operator when the cassettes 201*a*, 201*b* are to be retracted are aligned with each other, respectively, in the vertical direction, when the cassettes 201*a*, 201*b* are mounted to the printer, the outer configurations of the cassettes 201*a*, 201*b* are not offset from each other in a left-and-right direction, thereby providing good appearance.

In the illustrated embodiment, since the lower cassettes 201*b* and the lower sheet supply portion 203*b* are offset toward the downstream side of the upper cassettes 201*a* and the upper sheet supply portion 203*a* in the sheet conveying direction so that the distance between the upper sheet supply portion and the junction becomes equal to the distance between the lower sheet supply portion and the junction, a convey distance from the upper sheet supply portion to the image forming portion 101 becomes substantially the same as a convey distance from the lower sheet supply portion to the image forming portion, thereby eliminating or minimizing the difference in convey speed.

Thus, the optimum supply and separation condition regarding the upper sheet supply portion 203*a* can be substantially equal to that regarding the lower sheet supply portion 203*b*, thereby permitting the use of common parts. That is to say, the most important supply and separation conditions for the automatic sheet supply apparatus including biasing pressures and reverse torque values of the retard rollers 205*a*, 205*b*, materials forming the rollers and the like can be equalized regarding the upper and lower sheet supply portions, and important parts satisfying the supply and separation condition, for example, parts such as pick-up rollers 203*a*, 203*b*, feed rollers 204*a*, 204*b* and retard rollers 205*a*, 205*b* used for supply and separation of the sheets can be identical.

Further, by do so, since the endurances of the parts are equalized regarding the upper and lower sheet supply portions, service lives of the parts are also equalized regarding the upper and lower sheet supply portions. In the past, in order to avoid the confusion or trouble in the market, the exchange of parts was effected on the basis of the part having shorter service life. In the illustrated embodiment, however, such waste can be avoided.

Incidentally, so long as the supply and separation conditions are equalized regarding the upper and lower sheet supply portions 203*a*, 203*b* by constituting these portions by the identical parts, the convey distance between the upper sheet supply portion and the image forming portion may be differentiated from the convey distance between the lower sheet supply portion and the image forming portion. Further, since the optimum supply and separation conditions for the upper and lower sheet supply portions 203*a*, 203*b* have any plays to some extent, even if the convey distances are differentiated from each other more or less, the conveying speed of the sheet supply portions may be changed accordingly to equalize the sheet conveying times from the upper and lower cassettes 201*a*, 201*b*.

Next, other embodiments regarding an image forming apparatus will be explained with reference to the accompanying drawings.

In the case where each sheet supply portion is arranged in the proximity of the front end of the associated cassette and the cassettes are overlapped in the vertical direction, since the lower sheet supply portion must be arranged below the upper cassettes in a spaced relation, the entire height of the automatic sheet supply apparatus is increased.

Figure 26:
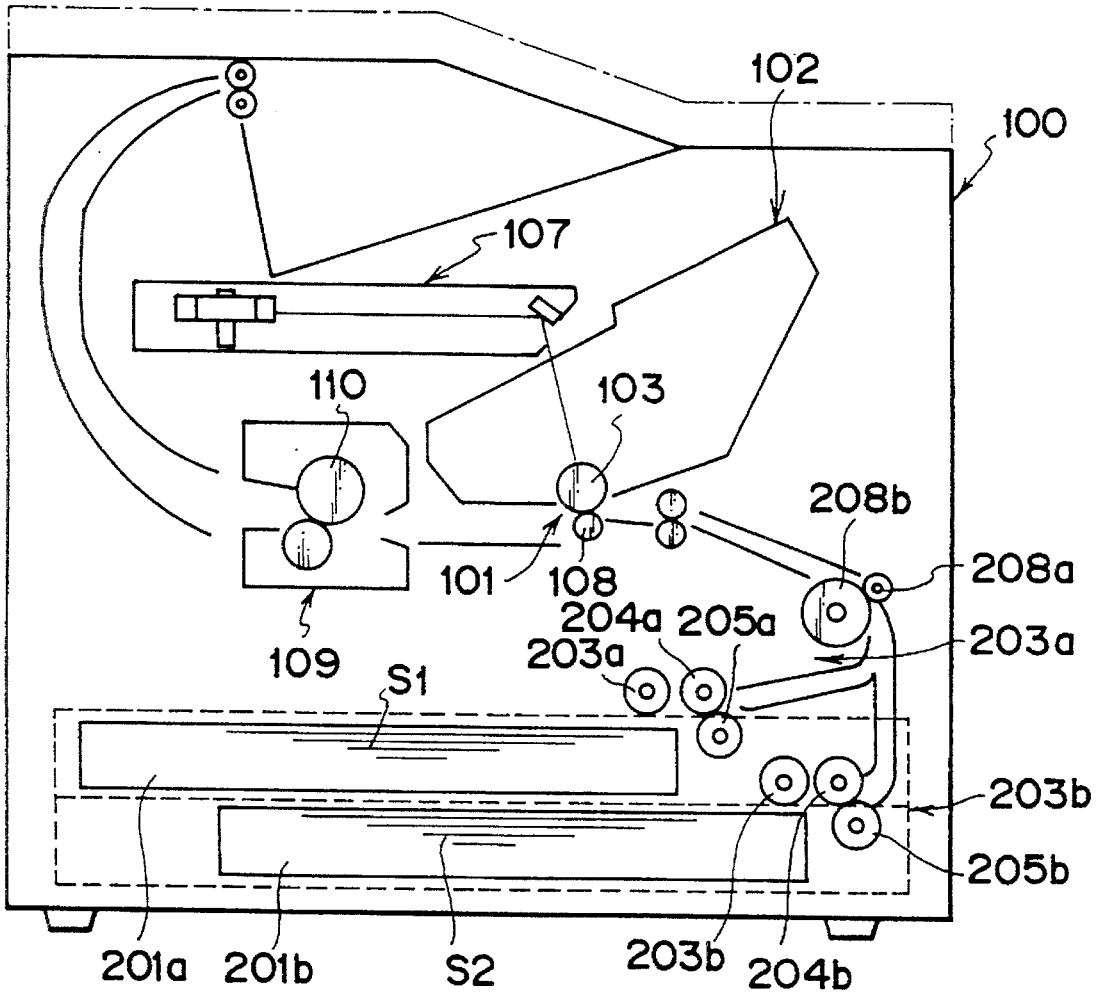
FIG. 26 is an elevational sectional view of an image forming apparatus according to a further embodiment of the present invention.

To avoid this, in an embodiment shown in FIG. 26, the lower cassette 201*b* is offset toward the downstream side of the upper cassette 201*a* in the sheet conveying direction so that the upper cassette 201*a* and the lower sheet supply portion 203*b* are arranged side by side in a horizontal direction. With this arrangement, the upper cassette 201*a* can be disposed adjacent to the lower cassette 201*b* in the vertical direction.

Incidentally, as is in the aforementioned embodiment, also in this embodiment, the outer profiles of the cassettes 201*a*, 201*b* looked at from the front side of the printer are the same as each other.

With this arrangement, not only the entire height of the automatic sheet supply apparatus can be greatly reduced, but also the useless space can be eliminated, thereby making the printer compact. In this way, since the cassettes 201*a*, 201*b* can be overlapped regardless of the height of the sheet supply portion 203*b*, it is possible to provide an automatic sheet supply apparatus wherein various kinds of sheets can be contained without increasing the total height of the printer and while making the apparatus compact.

Figure 27:
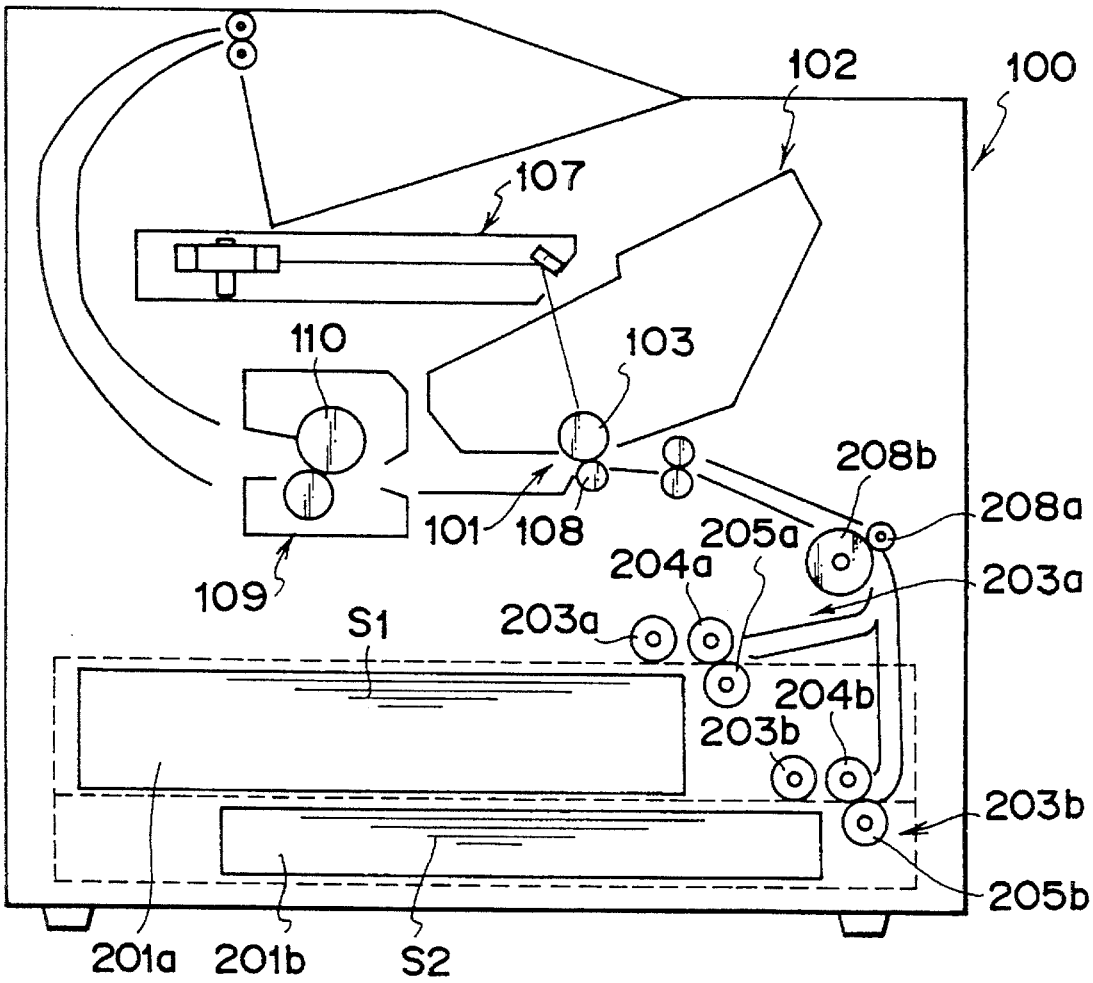
FIG. 27 is an elevational sectional view of an image forming apparatus according to a still further embodiment of the present invention.

In an embodiment shown in FIG. 27, a sheet stacking or containing amount is increased without increasing the height of the automatic sheet supply apparatus. That is to say, as is in the embodiment shown in FIG. 24, when the lower cassette 201*b* and the lower sheet supply portion 203*b* are offset toward the downstream side of the upper cassette 201*a* and the upper sheet supply portion 203*a* in the sheet conveying direction, a space between the upper and lower cassettes 201*a*, 201*b* is increased. In this embodiment, an upper cassette 201*a* is enlarged to fill such a space, thereby increasing the sheet containing ability of the upper cassette 201*a*'.

In this way, by utilizing the space created by offsetting the lower cassette 201*b* and the lower sheet supply portion 203*b* toward the downstream side of the sheet conveying direction, the sheet containing ability can be increased without increasing the height of the automatic sheet supply apparatus.

Figure 28:
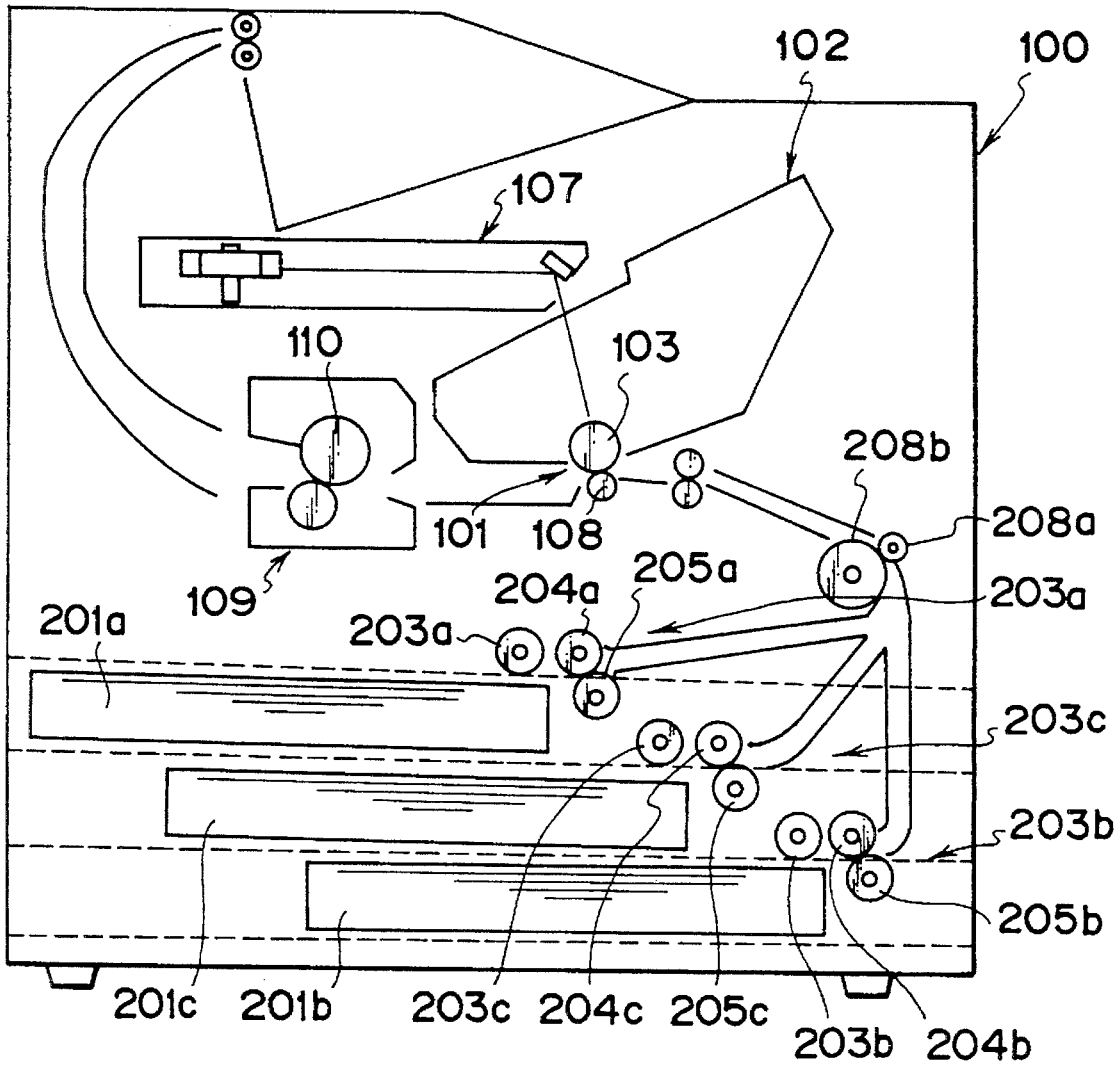
FIG. 28 is an elevational sectional view of an image forming apparatus according to a further embodiment of the present invention.

Also in this embodiment, the outer profiles of the cassettes 201*a*', 201*b* are aligned with each other in the vertical direction. In the above-mentioned embodiments, while examples that the sheet supply apparatus has two cassettes 201*a*, 201*b* were explained, the present invention is not limited to these examples. For example, as shown in FIG. 28, three cassettes 201*a*, 201*b*, 201*c* overlapped with each other in a vertical direction may be used. As shown in FIG. 28, an upper cassette 201*a* is arranged at a most upstream side of a sheet conveying direction, and a lower cassette 201*b* is arranged at a most downstream side of the sheet conveying direction with the interposition of an intermediate cassette 201*c* between the upper and lower cassettes.

When three cassettes 201*a*, 201*b*, 201*c* are used in this way, convey distances from the sheet supply portions 203*a*, 203*b*, 203*c* to the image forming portion 101 can also be equalized to each other, and the optimum supply and separation conditions for the sheet supply portions 203*a*, 203*b*, 203*c* can also be equalized to each other so that common parts can be used in the sheet supply portions. Further, the cassettes 201*a*, 201*b*, 201*c* and the sheet supply portions 203*a*, 203*b*, 203*c* can be offset in the left-and-right direction to reduce the height of the sheet supply apparatus, thereby making the apparatus compact.

Figure 29:
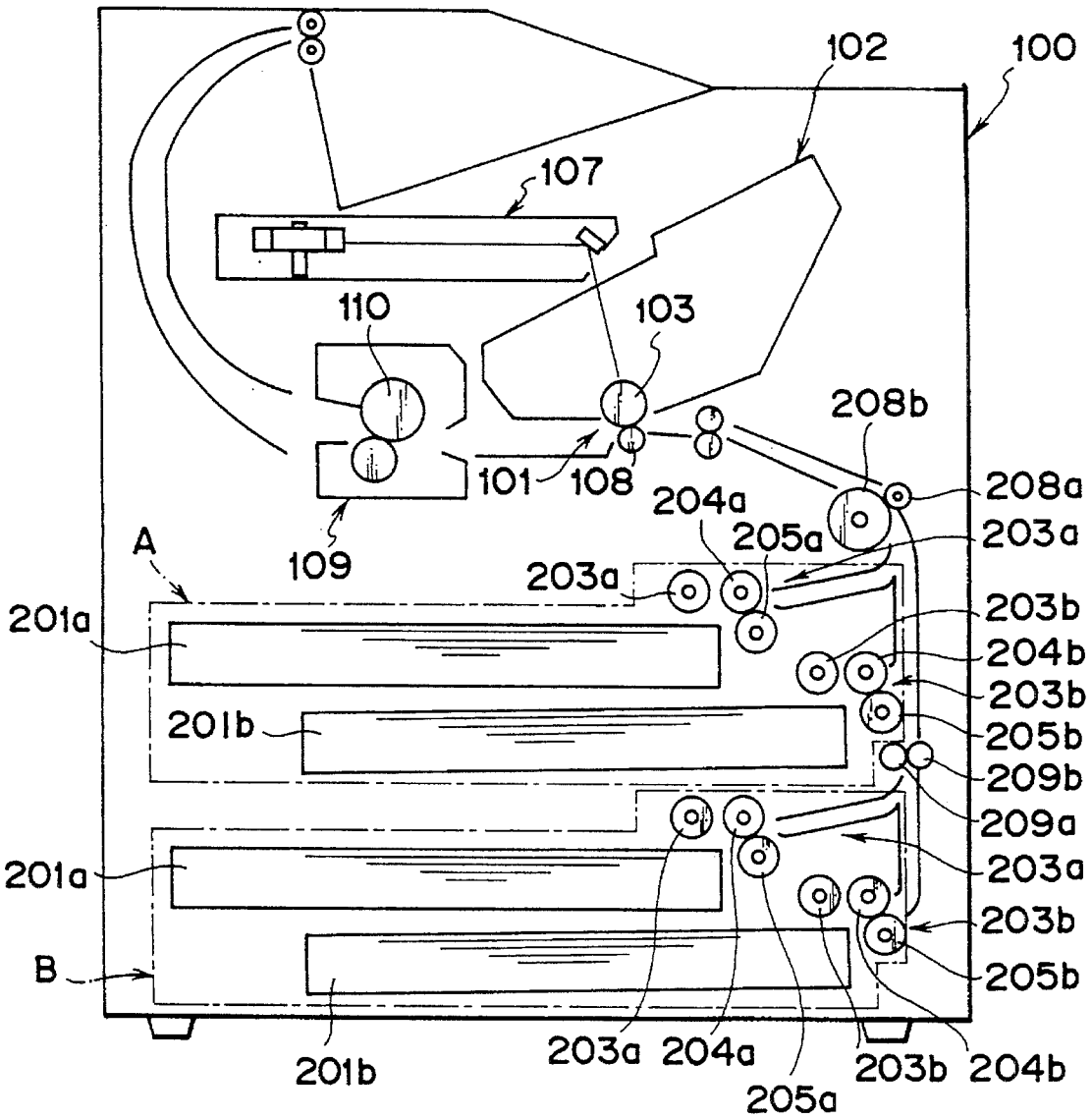
FIG. 29 is an elevational sectional view of an image forming apparatus according to the other embodiment of the pre sent invention.

Next, in an embodiment shown in FIG. 29, a plurality of modules each having an upper cassette 201*a* and a lower cassette 201*b* are adopted to an automatic sheet supply apparatus.

In this embodiment, each module includes two upper and lower cassettes 201*a*, 201*b* in which the lower cassette 201*b* and associated lower sheet supply portion 203*b* are offset toward a downstream side of a sheet conveying direction, and a plurality (two in the illustrated embodiment) of such modules A, B are overlapped in a vertical direction. The upper and lower sheet supply portions 203*a*, 203*b* in each module have the same convey and separation conditions, as is in the aforementioned embodiment, and the supply and separation conditions of the modules A, B are same as each other.

The sheet supplied from the module B is conveyed toward the image forming portion 101 by a pair of convey rollers 209*a*, 209*b* which are disposed in the convey path and which can adjust a sheet conveying speed. The sheet conveying speed provided by the pair of convey rollers 209*a*, 209*b* is selected to be greater than sheet feeding speeds provided by the sheet supply portions 203*a*, 203*b* so that the sheet supplied from the module B is pulled toward the downstream side at a high speed. Now, even when the sheet feeding speeds provided by the sheet supply portions 203*a*, 203*b* are differentiated from the sheet conveying speed provided by the pair of convey rollers 209*a*, 209*b*, since such difference in speed occurs after the sheet is separated and supplied at the sheet supply portion 203*a* or 203*b*, such difference does not affect a bad influence upon the supply and separation of the sheet.

In this way, by increasing the sheet conveying speed provided by the pair of convey rollers 209*a*, 209*b*, a time duration during which the sheet from the module A reaches the image forming portion 101 can be equalized to a time duration during which the sheet from the module B reaches the image forming portion 101. Further, since the sheet conveying speed provided by the pair of convey rollers 209*a*, 209*b* can be adjusted, by switching the sheet conveying speed in such a manner that the sheet conveying speed becomes the same as the sheet feeding speed provided by the sheet supply portion 203*a* or 203*b* when the sheet reaches the image forming portion 101, the sheet feeding speeds from the modules A, B can be equalized to each other at the image forming portion 101.

With this arrangement, the supply and separation conditions of the sheet supply portions 203*a*, 203*b* can be equalized and optimized, and, since the sheet conveying times (to the image forming portion 101) can be equalized by changing the sheet conveying speed even if the conveying distances are differentiated, the stable supply and separation can be achieved. Further, even when the plurality of cassettes are overlapped in the vertical direction, the height of the apparatus can be reduced.

In the embodiment shown in FIG. 29, while an example that two modules A, B are used were explained, it should be noted that three or more modules can be used.

Incidentally, in the above-mentioned embodiments, outer profiles of the upper and lower cassettes 201*a*, 201*b* looked at from the front side of the image forming apparatus are identical, and sheet size indication portions for indicating sizes of sheets contained in the cassettes, sheet remaining amount indication portions for indicating remaining amounts of sheets contained in the cassettes and grip portions for retracting the cassettes are provided on the respective cassettes in such a manner that such portions are aligned with each other in a vertical direction.

What is claimed is:

1. A sheet supply apparatus comprising:

a lifter means for maintaining a height of an upper surface of a sheet stack supported by a sheet supporting means substantially constant by lifting or lowering said sheet supporting means; and a supply means for feeding out an uppermost sheet from the sheet stack maintained in a constant height position by said lifter means;

wherein said lifter means comprises:

a clutch means for transmitting a predetermined amount of rotation from a drive gear;

a rock means for rocking a ratchet pawl by the rotation transmitted by said clutch means;

a ratchet gear engageable by said ratchet pawl and rotated by a rocking movement of said ratchet pawl;

a lifter member connected to said ratchet gear to lift said sheet supporting member by rotation of said ratchet gear; and an actuation means shifted in accordance with the height of the upper surface of the sheet stack rested on said sheet supporting means to actuate said clutch means when the height of the upper surface of the sheet stack is below a predetermined height.

2. A sheet supply apparatus according to claim 1, wherein said clutch means has a notched gear having a notched portion and a regulation means for regulating a position of said notched gear when said notched portion is opposed to said drive gear, and said clutch means serves to transmit a predetermined amount of rotation in such a manner that the rotation of said drive gear is transmitted to said notched gear when said notched gear is engaged by said drive gear and said notched gear is stopped when said notched portion is opposed to said drive gear.

3. A sheet supply apparatus according to claim 2, wherein said notched gear has one notched portion so that the transmission of the rotation is stopped whenever said notched gear is rotated by one revolution.

4. A sheet supply apparatus according to claim 2 or 3, wherein said actuation means includes a regulation release means shiftable in accordance with the height of the upper surface of the sheet stack rested on said sheet supporting means to release the regulation of said regulation means, and said regulation release means releases the regulation of said regulation means when the height of the upper surface of the sheet stack is below the predetermined height.

5. A sheet supply apparatus according to claim 4, wherein said regulation release means releases the regulation of said regulation means until the height of the upper surface of the sheet stack reaches the predetermined height, thereby causing said clutch means to transmit the predetermined amount of rotation repeatedly.

6. A sheet supply apparatus according to claim 5, wherein said supply means includes a pick-up roller capable of being abutted against the upper surface of the sheet stack rested on said sheet supporting means to feed out the sheet, and said regulation release means comprises a shaft on which said pick-up roller is rockably supported so that, when said pick-up roller is lowered as the number of sheets in the sheet stack is decreased, said shaft releases the regulation of said regulation means.

7. A sheet supply apparatus according to one of claims 2 or 3, wherein said rock means is a cam connected to said notched gear, and said ratchet pawl is rocked by rotation of said cam.

8. A sheet supply apparatus according to one of claims 2 or 3, further comprising a stopper pawl engaged by said ratchet gear to prevent said ratchet gear from rotating in a direction opposite to a direction that said ratchet gear is rotated by said ratchet pawl.

9. A sheet supply apparatus according to claim 8, wherein said sheet supporting means can be retracted from the sheet supply apparatus, and further comprising a cooperation member for regulating said regulation means non-releasably and releasing engagement between said stopper pawl and said ratchet gear in synchronous with a retracting movement of said sheet supporting means.

10. A sheet supply apparatus according to claim 8, wherein said sheet supporting means is constructed to be retracted from the sheet supply apparatus, and further comprising a lock means for regulating retraction of said sheet supporting means, a lock releasing switch for releasing said lock means, and a cooperation member for regulating said regulation means non-releasably and releasing engagement between said stopper pawl and said ratchet gear in synchronous with an operation of said lock releasing switch.

11. An image forming apparatus comprising:

a sheet supply apparatus according to one of claims 1 or 2; and an image forming means for forming an image on the sheet supplied from said sheet supply apparatus.

12. An image forming apparatus according to claim 11, wherein a plurality of said sheet supporting means are provided, said sheet supporting means can be retracted from the image forming apparatus in a direction perpendicular to a sheet supplying direction from said sheet supply apparatus, and said sheet supporting means are offset from each other in the sheet supplying direction so that distances between the respective sheet supporting means and said image forming means are equalized to each other.

13. An image forming apparatus according to claim 12, wherein outer profiles of said sheet supporting means along a retracting direction of said sheet supporting means are aligned with each other in a vertical direction.

14. An image forming apparatus according to claim 12, wherein one of maximum sheet stacking amounts of the respective sheet supporting means and sizes of the sheets stacked on the respective sheet supporting means are differentiated from each other.

15. A sheet supply apparatus comprising:

a sheet supporting means for supporting a sheet and removably mounted to the sheet supply apparatus;

a supply means movable in an up-and-down direction to be abutted against an upper surface of the sheet rested on said sheet supporting means for feeding out the sheet at a supply position;

a shift means for lowering said supply means to abut said supply means against the upper surface of the sheet when the sheet is to be supplied and for lifting said supply means to a waiting position spaced apart from the upper surface of the sheet when the sheet is not supplied;

a rock means for rocking a ratchet pawl by rotation of a drive gear;

a ratchet gear engageable by said ratchet pawl and rotated by a rocking movement of said ratchet pawl;

a lifter member connected to said ratchet gear and adapted to lift said sheet supporting member by rotation of said ratchet gear;

an actuation means for driving said rock means in accordance with an abutment position between said supply means at said supply position and the sheet supported by said sheet supporting means;

a lock means for regulating movement of said shift means under a condition that said supply means is lowered in response to a mounting operation of said sheet supporting means to the sheet supply apparatus; and a lock releasing means for releasing the regulation of said lock means when the upper surface of the sheet supported by said sheet supporting means is brought to a predetermined position by said lifter means.

16. A sheet supply apparatus according to claim 15, wherein said shift means has a notched gear clutch for controlling to interrupt transmission of a driving force when a notched portion of a notched gear is opposed to said drive gear, a cooperation cam synchronous with transmission of rotation of said notched gear clutch, and a connecting means for rocking said supply means by an operation of said cooperation cam.

17. A sheet supply apparatus according to claim 16, wherein, when said sheet supporting means is mounted to the sheet supply apparatus, said notched gear clutch transmits the rotation to cause said connecting means to lower said supply means, and said lock means regulates a movement of said connecting means in a condition that said supply means is lowered by said connecting means.

18. A sheet supply apparatus according to one of claims 15 to 17, wherein said rock means comprises a notched gear having a notched portion and adapted to interrupt the transmission of rotation when said notched portion is opposed to said drive gear, a regulation means for regulating said notched gear when said notched portion is opposed to said drive gear, and a cam connected to said notched gear and adapted to rock said ratchet pawl by rotation of said notched gear, and wherein said regulation means releases the regulation of said notched gear to engage said notched gear by said drive gear to thereby transmit the rotation when said supply means is below a first predetermined position, and regulates said notched gear to interrupt the transmission of rotation when said supply means reaches a second predetermined position.

19. A sheet supply apparatus according to claim 18, wherein said lock releasing means releases the regulation of said lock means at a third position between said first and second predetermined positions.

20. A sheet supply apparatus according to claim 15, wherein said sheet supporting means is a sheet cassette removably mounted to the sheet supply apparatus, and said lifter means lifts an intermediate plate for supporting the sheet in said sheet cassette.

21. A sheet supply apparatus according to claim 15, further comprising a keeper means for regulating said supply means in a waiting position when said sheet supporting means is not mounted to the sheet supply apparatus, and wherein said keeper means releases the regulation of said supply means when said sheet supporting means is mounted to the sheet supply apparatus.

22. An image forming apparatus comprising:

a sheet supply apparatus according to one of claims 15, 16, 17, 20 or 21; and an image forming means for forming an image on the sheet supplied from said sheet supply apparatus.

* * * * *

UNITED STATES PATENT AND TRADEMARK OFFICE

CERTIFICATE OF CORRECTION

PATENT NO. : 5,501,444

DATED : March 26, 1996

INVENTOR(S) : HIROSHI YUKIMACHI, ET AL.

It is certified that error appears in the above-indentified patent and that said Letters Patent is hereby corrected as shown below:

ON THE TITLE PAGE:

Item [30]; line FAPD, "Jan. 18, 1993 [JP] Japan....6-003622" should read --Jan. 18, 1994 [JP] Japan....6-003622--.

Column 1,
line 58, "feature" should read --features--.

Column 2,
line 42, "pre sent" should read --present--; and
line 52, "synchronous" should read --synchronism--.

Column 3,
line 46, "pre sent" should read --present--; and
line 61, "pre sent" should read --present--.

Column 4,
line 37, "synchronous" should read --synchronism--; and
line 44, "an" should read --a--.

Column 5,
line 43, "2" should read --22--; and
line 60, "Since the" should read --The--.

Column 11,
line 1, "$(P_2\text{-}5mm)<P_{1<P3}+5mm(=P_2+\Delta P+5mm)$" should read --$(P_2-5mm)<P_1<P_3+5mm(=P_2+\Delta P+5mm)$--.

UNITED STATES PATENT AND TRADEMARK OFFICE

CERTIFICATE OF CORRECTION

PATENT NO. : 5,501,444

DATED : March 26, 1996

INVENTOR(S) : HIROSHI YUKIMACHI, ET AL.

It is certified that error appears in the above-indentified patent and that said Letters Patent is hereby corrected as shown below:

Column 13,
line 22, "donwardly" should read --downwardly--;
line 56, "shows" should read --show--; and
line 67, "surface s" should read --surfaces--.

Column 18,
line 36, "shychronous" should read --synchronism--; and
line 46, "nous" should read --nism--.

Signed and Sealed this

Ninth Day of July, 1996

Bruce Lehman

*Attest:*

BRUCE LEHMAN

*Attesting Officer*

*Commissioner of Patents and Trademarks*